US011789388B2

(12) United States Patent
Kumagai et al.

(10) Patent No.: US 11,789,388 B2
(45) Date of Patent: Oct. 17, 2023

(54) IMAGE FORMING APPARATUS

(71) Applicants: Naohiro Kumagai, Kanagawa (JP); Tomoya Adachi, Kanagawa (JP); Yuusuke Furuichi, Kanagawa (JP)

(72) Inventors: Naohiro Kumagai, Kanagawa (JP); Tomoya Adachi, Kanagawa (JP); Yuusuke Furuichi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/571,836

(22) Filed: Jan. 10, 2022

(65) Prior Publication Data

US 2022/0283531 A1 Sep. 8, 2022

(30) Foreign Application Priority Data

Mar. 4, 2021 (JP) ..... 2021-034375

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2042; G03G 15/2046; G03G 15/2053; G03G 21/0005; G03G 21/0011; G03G 21/0017; G03G 21/0029; G03G 2221/0005; G03G 2221/0026; G03G 2221/0089
See application file for complete search history.

(56) References Cited

U.S. PATENT DOCUMENTS 6,266,502 B1 7/2001 Matsuzaki et al.
2002/0018670 A1* 2/2002 Shoji ..... G03G 21/0005 399/350
2002/0160287 A1* 10/2002 Miyamoto ..... G03G 5/04 430/31
2007/0036595 A1 2/2007 Amemiya et al.
(Continued)

FOREIGN PATENT DOCUMENTS

EP 2947520 A1 11/2015
JP 7-311526 11/1995
(Continued)

OTHER PUBLICATIONS

JP 07311526 English machine translation, Ishibashi et al., Nov. 28, 1995 (Year: 1995).*
(Continued)

*Primary Examiner* — Thomas S Giampaolo, II
(74) *Attorney, Agent, or Firm* — Harness, Dickey & Pierce, P.L.C.

(57) ABSTRACT

An image forming apparatus includes a heating device, a rotator, and a blade. The heating device includes a heater extending in a direction orthogonal to a conveyance direction of a recording medium. The heater includes a heat generator and generates a larger heat amount at one end than at a center. The blade includes a rubbing portion extending in the direction. Both ends of the rubbing portion face both ends of the heater. The rotator and the blade are configured such that a friction force between the rotator and one end of the rubbing portion is smaller than a friction force between the rotator and the center of the rubbing portion in the direction.

20 Claims, 21 Drawing Sheets

(56) References Cited

U.S. PATENT DOCUMENTS

| | | | | |
|---|---|---|---|---|
| 2007/0154246 | A1 | 7/2007 | Shintani et al. | |
| 2012/0063827 | A1 | 3/2012 | Kumagai | |
| 2015/0147074 | A1 | 5/2015 | Wada et al. | |
| 2015/0205248 | A1 | 7/2015 | Yogosawa et al. | |
| 2016/0124374 | A1 | 5/2016 | Yogosawa et al. | |
| 2016/0170365 | A1 | 6/2016 | Mitani et al. | |
| 2016/0216647 | A1 | 7/2016 | Yogosawa et al. | |
| 2020/0292973 | A1 | 9/2020 | Furuichi et al. | |
| 2020/0387096 | A1 | 12/2020 | Adachi et al. | |
| 2021/0041810 | A1 | 2/2021 | Furuichi | |
| 2021/0041832 | A1 | 2/2021 | Furuichi | |
| 2021/0157259 | A1* | 5/2021 | Inoue | H05B 3/03 |
| 2021/0165350 | A1* | 6/2021 | Seki | G03G 15/2064 |
| 2021/0165351 | A1* | 6/2021 | Doda | G03G 15/2042 |
| 2021/0181661 | A1* | 6/2021 | Seki | G03G 15/2053 |
| 2021/0271190 | A1* | 9/2021 | Seki | G03G 15/2064 |
| 2021/0278790 | A1 | 9/2021 | Furuichi et al. | |
| 2021/0318655 | A1 | 10/2021 | Inoue et al. | |
| 2021/0364958 | A1 | 11/2021 | Someya et al. | |
| 2021/0389713 | A1* | 12/2021 | Yabe | G03G 15/2042 |

FOREIGN PATENT DOCUMENTS

| | | |
|---|---|---|
| JP | 2014-002352 | 1/2014 |
| JP | 2016-062024 | 4/2016 |
| WO | WO-2020/066753 A1 | 4/2020 |

OTHER PUBLICATIONS

Extended European Search Report dated Jun. 29, 2022, issued in corresponding European Patent Application No. 22150720.5.

* cited by examiner

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | 10000 | 6400 | 3600 | 1600 | 400 | — | — |
| HEAT GENERATION AMOUNT OF SECOND POWER SUPPLY LINE 62B | — | 400 | 1600 | 3600 | 6400 | 10000 | 14400 |
| HEAT GENERATION AMOUNT OF FOURTH POWER SUPPLY LINE 62D | 400 | 400 | 400 | 400 | 400 | 400 | — |
| TOTAL HEAT GENERATION AMOUNT | 10400 | 7200 | 5600 | 5600 | 7200 | 10400 | 14400 |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | | 6400 | 3600 | 1600 | 400 | — | |
| HEAT GENERATION AMOUNT OF SECOND POWER SUPPLY LINE 62B | | 25 | 225 | 1225 | 3025 | 5625 | |
| HEAT GENERATION AMOUNT OF FOURTH POWER SUPPLY LINE 62D | | 25 | 25 | 25 | 25 | 25 | |
| TOTAL HEAT GENERATION AMOUNT | | 6450 | 3850 | 2850 | 3450 | 5650 | |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | | 6400 | 3600 | 1600 | — | — | |
| HEAT GENERATION AMOUNT OF SECOND POWER SUPPLY LINE 62B | | 25 | 225 | 1225 | 3025 | 5625 | |
| HEAT GENERATION AMOUNT OF FOURTH POWER SUPPLY LINE 62D | | 25 | 25 | 25 | 25 | 25 | |
| HEAT GENERATION AMOUNT OF FIFTH POWER SUPPLY LINE 62E | | 10000 | 10000 | 10000 | 10000 | 10000 | |
| TOTAL HEAT GENERATION AMOUNT | | 16450 | 13450 | 12850 | 13050 | 15650 | |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | 10000 | 6400 | 3200 | 1600 | 400 | — | — |
| HEAT GENERATION AMOUNT OF SECOND POWER SUPPLY LINE 62B | — | 400 | 1600 | 3600 | 6400 | 10000 | 14400 |
| HEAT GENERATION AMOUNT OF FOURTH POWER SUPPLY LINE 62D | 400 | 400 | 400 | 400 | 400 | 400 | 400 |
| HEAT GENERATION AMOUNT OF FIFTH POWER SUPPLY LINE 62E | 19600 | 19600 | 19600 | 19600 | 19600 | 19600 | 19600 |
| TOTAL HEAT GENERATION AMOUNT | 30000 | 26800 | 24800 | 25200 | 26800 | 30000 | 34400 |

IMAGE FORMING APPARATUS

CROSS-REFERENCE TO RELATED APPLICATION

This patent application is based on and claims priority pursuant to 35 U.S.C. § 119(a) to Japanese Patent Application No. 2021-034375, filed on Mar. 4, 2021 in the Japan Patent Office, the entire disclosure of which is incorporated by reference herein.

BACKGROUND

Technical Field

Embodiments of the present disclosure generally relate to an image forming apparatus.

Related Art

As an image forming apparatus such as a copier or a printer, an electrophotographic image forming apparatus that forms an image using toner is known.

In general, the electrophotographic image forming apparatus includes a fixing device that fixes a toner image onto a sheet. The fixing device includes a heating member such as a heater that heats the sheet. When the sheet passes through the fixing device, the heating member heats the sheet so that the toner on the sheet is melted and fixed to the sheet.

SUMMARY

This specification describes an improved image forming apparatus to form an image on a recording medium. The image forming apparatus includes a heating device, a rotator, and a blade. The heating device heats the recording medium conveyed and includes a heater. The heater includes a heat generator and extends in a direction orthogonal to a conveyance direction of the recording medium. The heater generates a larger amount of heat at one end in the direction orthogonal to the conveyance direction than at a center of the heater in the direction orthogonal to the conveyance direction. The blade includes a rubbing portion. The rubbing portion extends in the direction orthogonal to the conveyance direction. One end of the rubbing portion in the direction orthogonal to the conveyance direction faces the one end of the heater in the direction orthogonal to the conveyance direction. The other end of the rubbing portion in the direction orthogonal to the conveyance direction faces the other end of the heater in the direction orthogonal to the conveyance direction. The rubbing portion rubs a rotator. The rotator and the blade are configured such that a friction force between the rotator and the one end of the rubbing portion is smaller than a friction force between the rotator and the center of the rubbing portion in the direction orthogonal to the conveyance direction.

This specification further describes an improved image forming apparatus to form an image on the recording medium. The image forming apparatus includes a heating device, a rotator, and a blade. The heating device heats the recording medium conveyed and includes a heater. The heater includes a heat generator and extends in a direction orthogonal to the conveyance direction of the recording medium. The heater is configured such that a total value of squares of currents flowing through one end of the heater in the direction orthogonal to the conveyance direction is larger than a total value of squares of currents flowing through a center of the heater in the direction orthogonal to the conveyance direction. The blade includes a rubbing portion. The rubbing portion extends in the direction orthogonal to the conveyance direction. The rubbing portion faces the heater. The rubbing portion rubs the rotator. The rotator and the blade are configured such that a friction force between the rotator and one end of the rubbing portion facing the one end of the heater is smaller than a friction force between the rotator and the center of the rubbing portion in the direction orthogonal to the conveyance direction.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
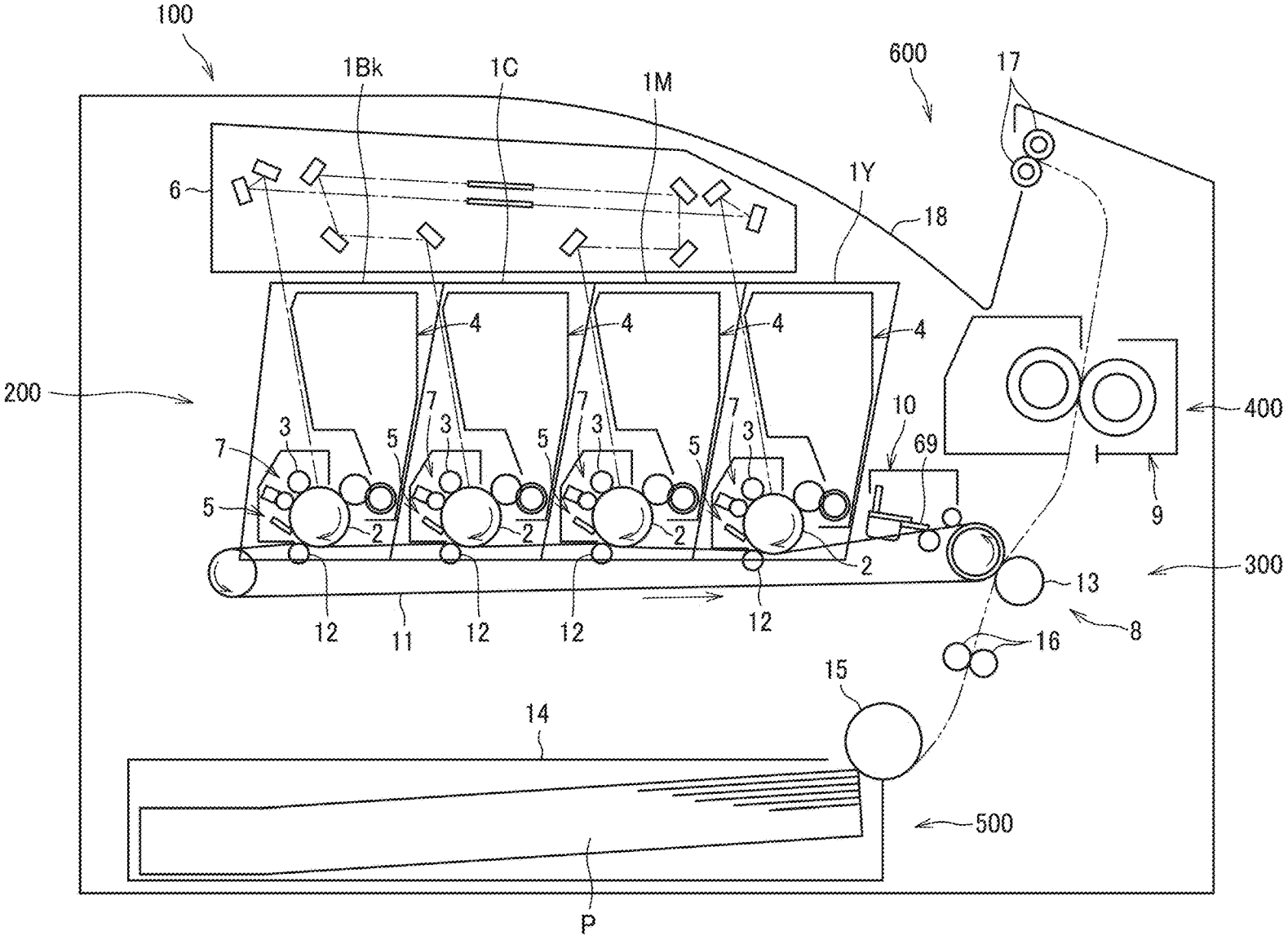
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

With reference to drawings attached, a description is given below of the present disclosure. In the drawings for illustrating embodiments of the present disclosure, identical reference numerals are assigned to elements such as members and parts that have an identical function or an identical shape as long as differentiation is possible, and descriptions of such elements may be omitted once the description is provided.

FIG. 1 is a schematic diagram illustrating a configuration of the image forming apparatus according to an embodiment of the present disclosure.

The image forming apparatus 100 illustrated in FIG. 1 includes an image forming section 200 as an image forming device, a transfer section 300, a fixing section 400, a recording medium supply section 500, and a recording medium ejection section 600.

The image forming section 200 includes four process units 1Y, 1M, 1C, and 1Bk and an exposure device 6. Each of the four process units 1Y, 1M, 1C, and 1Bk is an image forming unit removably installed in the body of the image forming apparatus 100. The process units 1Y, 1M, 1C, and 1Bk have the same configuration except for containing different color toners (developers), i.e., yellow (Y), magenta (M), cyan (C), and black (Bk) toners, respectively, corresponding to decomposed color separation components of full-color images. Each of the process units 1Y, 1M, 1C, and 1Bk includes a photoconductor 2, a charger 3, a developing device 4, a cleaning device 5, and a lubricant supply device 7.

The photoconductor 2 is an image bearer bearing an image on the surface of the photoconductor 2. The image forming apparatus 100 in the present embodiment includes a drum-shaped photoconductor (a photoconductor drum) as the photoconductor 2. Alternatively, the image forming apparatus 100 may include a belt-shaped photoconductor (a photoconductor belt) as the photoconductor 2.

The charger 3 is a member that charges the surface of the photoconductor 2. The charger 3 in the present embodiment is a charging roller that contacts the surface of the photoconductor 2. However, the charger 3 is not limited to a contact type and may be a non-contact type such as a corona charger.

The developing device 4 supplies the toner as the developer to the surface of the photoconductor 2. For example, the developing device 4 includes a developer supply member such as a developing roller in contact with the photoconductor 2. As the developer supply member rotates, the developer (the toner) borne on the developer supply member is supplied to the surface of the photoconductor 2.

Figure 2:
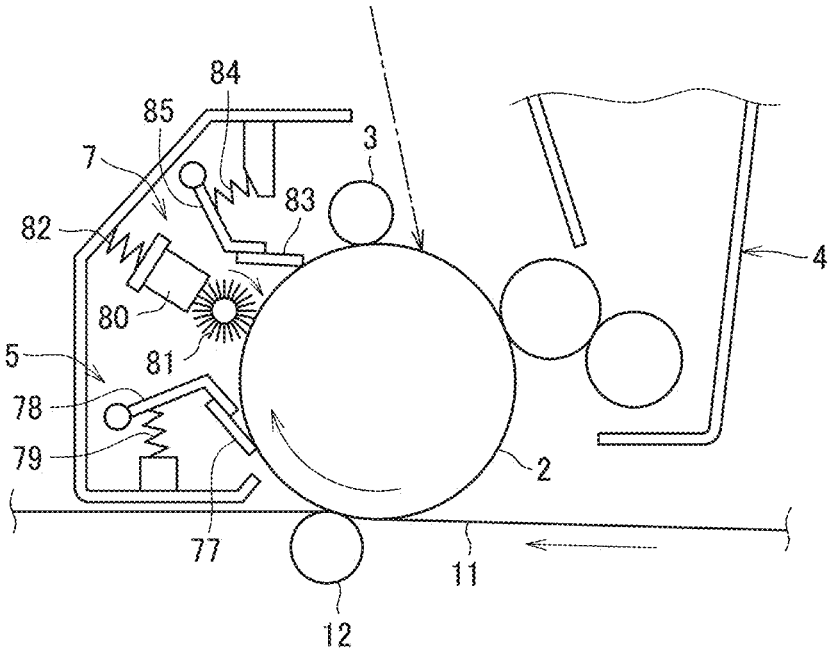
FIG. 2 is a schematic diagram illustrating a configuration of a process unit in the image forming apparatus of FIG. 1.

The cleaning device 5 cleans the surface of the photoconductor 2 that is a cleaning target. As illustrated in FIG. 2, the cleaning device 5 includes a cleaning blade 77, a blade holder 78, and a spring 79 serving as a blade biasing member. The cleaning blade 77 is a plate made of an elastic material such as urethane rubber and is held in a cantilever manner by a blade holder 78. The spring 79 applies a biasing force to the blade holder 78, and the blade holder 78 holds the cleaning blade 77 to be in contact with the surface of the photoconductor 2. When the photoconductor 2 rotates in this state, the cleaning blade 77 rubs against the rotating photoconductor 2 to remove foreign substances such as residual toner on the photoconductor 2.

The lubricant supply device 7 supplies lubricant onto the photoconductor 2. As illustrated in FIG. 2, the lubricant supply device 7 includes lubricant 80, a brush roller 81 as a lubricant applicator, a spring 82 as a lubricant biasing member, a coating blade 83 as a thin layering member, a coating blade holder 85, and a spring 84 as a blade biasing member. The spring 82 presses the lubricant 80 against the brush roller 81. As the brush roller 81 pressed by the lubricant 80 rotates, the lubricant 80 is scraped off by the brush roller 81 and supplied to the surface of the photoconductor 2. The spring 79 sets the coating blade 83 to be in contact with the surface of the photoconductor 2. The above-described configuration passes the lubricant supplied to the surface of the photoconductor 2 through a contact portion between the photoconductor 2 and the coating blade 83 to form a thin layer having a uniform thickness and apply the lubricant to the surface of the photoconductor 2.

As illustrated in FIG. 1, the transfer section 300 includes a transfer device 8 that transfers the image to a recording medium such as a sheet. The recording medium on which the image is transferred may be a sheet of paper made of plain paper, thick paper, thin paper, coated paper, and label paper, envelopes, or a resin sheet such as an overhead projector (OHP) transparency. The transfer device 8 includes an intermediate transfer belt 11, primary transfer rollers 12, a secondary transfer roller 13, and a belt cleaner 10. The intermediate transfer belt 11 is an endless belt stretched by a plurality of rollers. The primary transfer rollers 12 faces the photoconductor 2. The number of the primary transfer rollers 12 are the same as the number of the photoconductors 2. Each of the primary transfer rollers 12 is in contact with the corresponding photoconductor 2 via the intermediate transfer belt 11 to form a primary transfer nip between the intermediate transfer belt 11 and each photoconductor 2. Each of the photoconductors 2 is in contact with the intermediate transfer belt 11 at each of the primary transfer nips. Via the intermediate transfer belt 11, the secondary transfer roller 13 is in contact with one of a plurality of rollers around which the intermediate transfer belt 11 is stretched. The above-described configuration forms a secondary transfer nip between the intermediate transfer belt 11 and the secondary transfer roller 13. The belt cleaner 10 includes a cleaning blade 69 that contacts the surface of the intermediate transfer belt 11.

The fixing section 400 includes a fixing device 9 that fixes the image onto the sheet. A detailed configuration of the fixing device 9 is described below.

The recording medium supply section 500 includes a sheet tray 14 to store sheets P as recording media and a feed roller 15 to feed the sheet P from the sheet tray 14.

The recording medium ejection section 600 includes an output roller pair 17 to eject the sheet to the outside of the image forming apparatus and an output tray 18 on which the sheet ejected by the output roller pair 17 is placed.

Next, a printing operation of the image forming apparatus 100 according to the present embodiment is described with reference to FIG. 1.

When the image forming apparatus 100 starts a print operation, the photoconductors 2 of the process units 1Y, 1M, 1C, and 1Bk and the intermediate transfer belt 11 start rotating. The feed roller 15 starts to rotate and feed the sheet P from the sheet tray 14. The sheet P fed from the sheet tray 14 is brought into contact with the timing roller pair 16 and temporarily stopped.

Firstly, in each of the process units 1Y, 1M, 1C, and 1Bk, the charger 3 uniformly charges the surface of the photoconductor 2 to a high potential. Next, the exposure device 6 exposes the surface (that is, the charged surface) of each photoconductor 2 based on image data of a document read by a document reading device or print image data sent from a terminal that sends a print instruction. As a result, the potential of the exposed portion on the surface of each photoconductor 2 decreases, and an electrostatic latent image is formed on the surface of each photoconductor 2. The developing device 4 supplies toner to the electrostatic latent image formed on the photoconductor 2, forming a toner image thereon. The image forming apparatus 100 according to the present embodiment uses all process units 1Y, 1M, 1C, 1Bk to form the full color toner image. Alternatively, the image forming apparatus 100 can form a monochrome toner image by using any one of the four process units 1Y, 1M, 1C, and 1Bk, or can form a bicolor toner image or a tricolor toner image by using two or three of the process units 1Y, 1M, 1C, and 1Bk.

When the toner images formed on the photoconductors 2 reach the primary transfer nips defined by the primary transfer rollers 12 with the rotation of the photoconductors 2, the toner images formed on the photoconductors 2 are transferred onto the intermediate transfer belt 11 rotated counterclockwise in FIG. 1 successively such that the toner images are superimposed on the intermediate transfer belt 11, forming a full color toner image thereon. After the toner images are transferred onto the intermediate transfer belt 11, the cleaning device 5 cleans the surface of each photoconductor 2, the lubricant supply device 7 supplies a lubricant to the surface of each photoconductor 2, and the photoconductor 2 is prepared for a next image formation.

In accordance with rotation of the intermediate transfer belt 11, the full color toner image transferred onto the intermediate transfer belt 11 reaches the secondary transfer nip at the secondary transfer roller 13 and is transferred onto the sheet P conveyed by the timing roller pair 16 at the secondary transfer nip. Subsequently, the belt cleaner 10 cleans the surface of the intermediate transfer belt 11 in preparation for subsequent image formation.

After the full color toner image is transferred onto the sheet P, the sheet P is conveyed to the fixing device 9, and the fixing device 9 fixes the full color toner image onto the sheet P. The output roller pair 17 ejects the sheet P bearing the fixed toner image to the output tray 18. Thus, a series of image forming operations is completed.

Next, a description is given of the configuration of the fixing device 9 according to the present embodiment.

Figure 3:
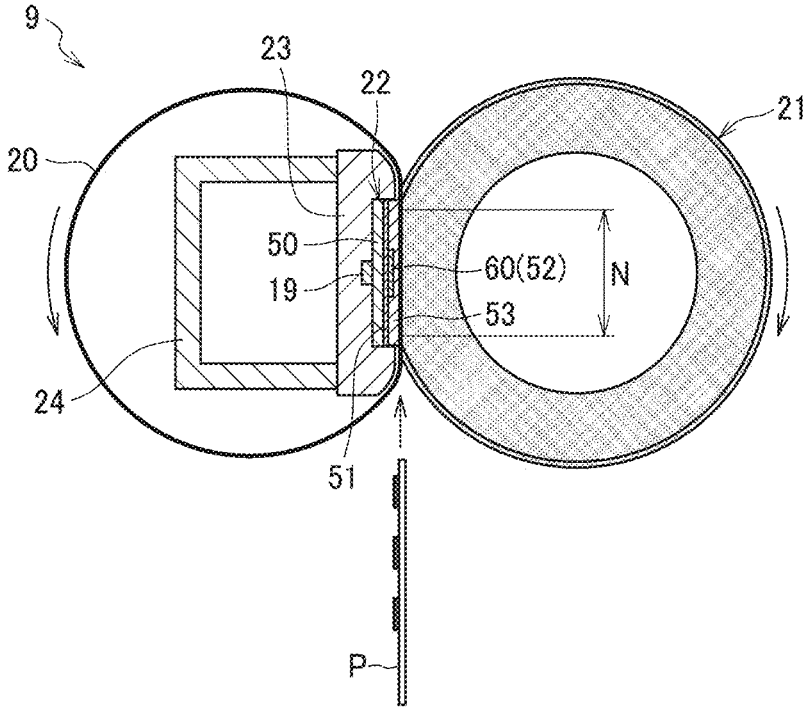
FIG. 3 is a schematic diagram illustrating a configuration of a fixing device incorporated in the image forming apparatus of FIG. 1.

As illustrated in FIG. 3, the fixing device 9 according to the present embodiment includes a fixing belt 20, a pressure roller 21, a heater 22, a heater holder 23, a stay 24, and a temperature sensor 19.

The fixing belt 20 is a rotator (a first rotator) that functions as a fixing rotator to fix an unfixed toner image onto the sheet P and is disposed so as to face a side of the sheet P on which the unfixed toner image is borne, that is, an image formed surface of the sheet P. The fixing belt 20 includes, for example, a base made of polyimide. The base of the fixing belt 20 may be made of heat-resistant resin such as polyetheretherketone (PEEK) or metal such as nickel (Ni) or stainless steel (Stainless Used Steel, SUS), in addition to polyimide. A release layer made of fluoroplastic such as perfluoroalkoxy alkane (PFA) or polytetrafluoroethylene (PTFE) may coat an outer circumferential surface of the base to facilitate separation of foreign substances from the fixing belt 20 and improve the durability of the fixing belt 20. An elastic layer made of rubber or the like may be interposed between the base and the release layer. Additionally, a sliding layer made of polyimide, polytetrafluoroethylene (PTFE), or the like may be provided on the inner circumferential surface of the base.

The pressure roller 21 is an opposed member disposed opposite an outer circumferential surface of the fixing belt 20 and is referred to as a second rotator different from the first rotator that is the fixing belt 20. The pressure roller 21 includes a cored bar made of metal; an elastic layer coating the cored bar and being made of silicone rubber or the like; and a release layer coating the elastic layer and being made of fluororesin or the like.

The pressure roller 21 is pressed against the fixing belt 20 by a biasing member such as a spring. Thus, the nip N is formed between the fixing belt 20 and the pressure roller 21. A driving force is transmitted to the pressure roller 21 from a driver disposed in the body of the image forming apparatus 100. As the driver drives and rotates the pressure roller 21, the driving force of the driver is transmitted from the pressure roller 21 to the fixing belt 20 at the nip N, thereby rotating the fixing belt 20. As illustrated in FIG. 3, the sheet P bearing the unfixed toner image enters the nip N between the rotating fixing belt 20 and the rotating pressure roller 21, and the fixing belt 20 and the pressure roller 21 convey the sheet P and apply heat and pressure to the sheet P. As a result, the unfixed toner image on the sheet P is fixed to the sheet P.

The heater 22 is a heating member that heats the fixing belt 20. In the present embodiment, the heater 22 includes a planar base 50, a first insulation layer 51 disposed on the base 50, a conductor layer 52 disposed on the first insulation layer 51, and a second insulation layer 53 that covers the conductor layer 52. The conductor layer 52 includes resistive heat generators 60 that are energized to generate heat.

In the present embodiment, since the resistive heat generators 60 are disposed above a side of the base 50 facing the nip N, the heat of the resistive heat generators 60 is transmitted to the fixing belt 20 without passing through the base 50 and can efficiently heat the fixing belt 20. Alternatively, the heat generators 60 may be disposed above a side of the base 50 opposite the side of the base 50 facing the nip N. In this case, since the heat of the heat generators 60 is transmitted to the fixing belt 20 through the base 50, it is preferable that the base 50 be made of a material with high thermal conductivity such as aluminum nitride.

In the present embodiment, the heater 22 directly contacts the inner circumferential surface of the fixing belt 20 to efficiently conduct heat from the heater 22 to the fixing belt 20. The heater 22 is not limited to the heater that directly contacts the fixing belt 20 and may not contact the fixing belt 20 or may contact the fixing belt 20 indirectly via, e.g., a low-friction sheet. The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Therefore, it is preferable that the heater 22 contacts the inner circumferential surface of the fixing belt 20 rather than the outer circumferential surface of the fixing belt 20.

The heater holder 23 is a heating member holder disposed inside the loop of the fixing belt 20 to hold the heater 22 contacting the inner circumferential surface of the fixing belt 20. Since the heater holder 23 is subject to temperature increase by heat from the heater 22, the heater holder 23 is preferably made of a heat resistant material. When the heater holder 23 is made of heat-resistant resin having low thermal conduction, such as a liquid crystal polymer (LCP) or polyether ether ketone (PEEK), the heater holder 23 can have a heat-resistant property and reduce heat transfer from the heater 22 to the heater holder 23. Therefore, the heater 22 can efficiently heats the fixing belt 20.

The stay 24 is a reinforcement disposed inside the loop of the fixing belt 20 to reinforce the heater 22 and the heater holder 23. The stay 24 supports a stay side face of the heater holder 23. The stay side face is opposite a nip side face of the heater holder 23. Accordingly, the stay 24 prevents the heater holder 23 from being bended by a pressing force of the pressure roller 21. Thus, the fixing nip N is formed between the fixing belt 20 and the pressure roller 21 to be a uniform width. The stay 24 is preferably made of an iron-based metal such as stainless steel (SUS) or steel electrolytic cold commercial (SECC) that is electrogalvanized sheet steel to ensure rigidity.

The temperature sensor 19 is a temperature detector that detects the temperature of the heater 22. The temperature sensor 19 may be a known temperature sensor such as a thermopile, a thermostat, a thermistor, or a non-contact (NC) sensor. The temperature sensor 19 may be either a contact type temperature sensor disposed to be in contact with the heater 22 or a non-contact type temperature sensor facing and being away from the heater 22. The temperature sensor 19 in the present embodiment is disposed so as to be in contact with a surface of the heater 22 opposite a surface of the heater 22 facing the nip N.

Figure 4:
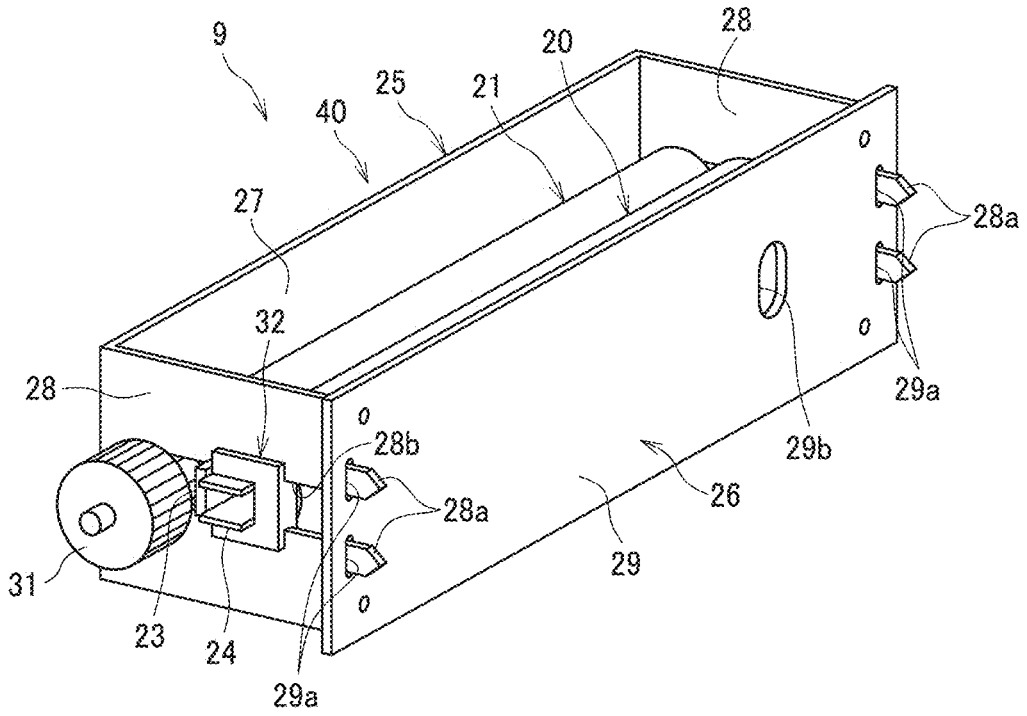
FIG. 4 is a perspective view of the fixing device of FIG. 3.
Figure 5:
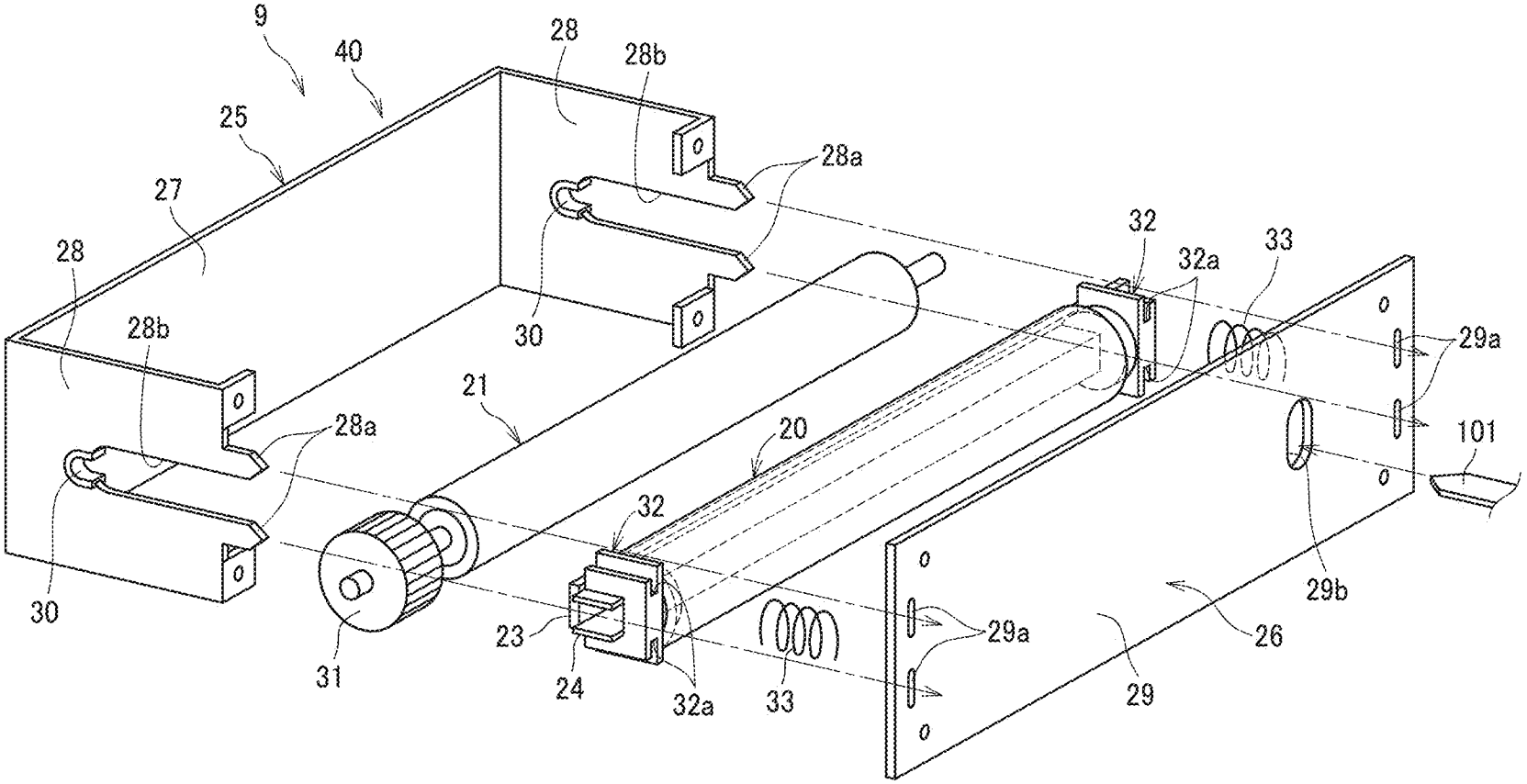
FIG. 5 is an exploded perspective view of the fixing device of FIG. 3.

FIG. 4 is a perspective view of the fixing device 9 according to the present embodiment, and FIG. 5 is an exploded perspective view of the fixing device 9.

As illustrated in FIGS. 4 and 5, the fixing device 9 includes a device frame 40 that includes a first device frame 25 and a second device frame 26. The first device frame 25 includes a pair of side walls 28 and a front wall 27. The second device frame 26 includes a rear wall 29. One of the pair of side walls 28 is disposed at one end of the fixing belt 20 in the longitudinal direction of the fixing belt 20, and the other one of the pair of side walls 28 is disposed at the other end of the fixing belt 20 in the longitudinal direction. The side walls 28 support both ends of the pressure roller 21 and both ends of the fixing belt 20. Each side wall 28 has a plurality of engagement projections 28*a*. As the engagement projections 28*a* engage corresponding coupling holes 29*a* in the rear wall 29, the first device frame 25 is coupled to the second device frame 26.

Each of the side walls 28 has an insertion groove 28*b* through which a rotation shaft and the like of the pressure roller 21 are inserted. The insertion groove 28*b* opens toward the rear wall 29 and closes at a portion opposite the rear wall 29, and the portion of the insertion groove 28*b* opposite the rear wall 29 serves as a contact portion. A bearing 30 is disposed at an end of the contact portion to support the rotation shaft of the pressure roller 21. Since both ends of the rotation shaft of the pressure roller 21 are attached to the bearings 30, respectively, the side walls 28 rotatably support the pressure roller 21.

A driving force transmission gear 31 serving as a drive transmitter is disposed at one end of the rotation shaft of the pressure roller 21 in an axial direction thereof. When the side walls 28 support the pressure roller 21, the driving force transmission gear 31 is exposed outside the side wall 28. Accordingly, when the fixing device 9 is installed in the body of the image forming apparatus 100, the driving force transmission gear 31 is coupled to a gear disposed inside the body of the image forming apparatus 100 so that the driving force transmission gear 31 transmits the driving force from a driver to the pressure roller 21. The drive transmitter to transmit the driving force to the pressure roller 21 is not limited to the driving force transmission gear 31 and may be pulleys over which a driving force transmission belt is stretched taut, a coupler, or the like.

A pair of supports 32 is disposed at both lateral ends of the fixing belt 20 in a longitudinal direction thereof, respectively to support the fixing belt 20 and the stay 24. The pair of supports 32 support the fixing belt 20, the heater holder 23, the stay 24, and the like. Each support 32 has guide grooves 32*a*. The edges of the insertion groove 28*b* of the side wall 28 move along the guide grooves 32*a*, respectively, to enter the support 32 into the insertion groove 28*b*, and the support 32 is attached to the side wall 28.

A pair of springs 33 serving as a pair of biasing members is interposed between each of the supports 32 and the rear wall 29. As the springs 33 bias the supports 32 and the stay 24 toward the pressure roller 21, respectively, the fixing belt 20 is pressed against the pressure roller 21 to form the fixing nip between the fixing belt 20 and the pressure roller 21.

As illustrated in FIG. 5, a hole 29*b* is disposed near one end of the rear wall 29 of the second device frame 26 in a longitudinal direction of the second device frame 26. The hole 29*b* is a positioner to position the body of the fixing device 9 with respect to the body of the image forming apparatus 100. On the other hand, the body of the image forming apparatus 100 includes a projection 101 serving as a positioner. The projection 101 is inserted into the hole 29*b* of the fixing device 9. Accordingly, the projection 101 engages the hole 29*b*, positioning the body of the fixing device 9 with respect to the body of the image forming apparatus 100 in the longitudinal direction of the fixing belt 20. Although the hole 29*b* serving as the positioner is disposed near one end of the rear wall 29 in the longitudinal direction of the second device frame 26, a positioner is not disposed near another end of the rear wall 29. Such a configuration does not restrict thermal expansion or shrinkage of the body of the fixing device in the longitudinal direction of the fixing belt caused by changes in temperature and prevents the body of the fixing device from deforming.

Figure 6:
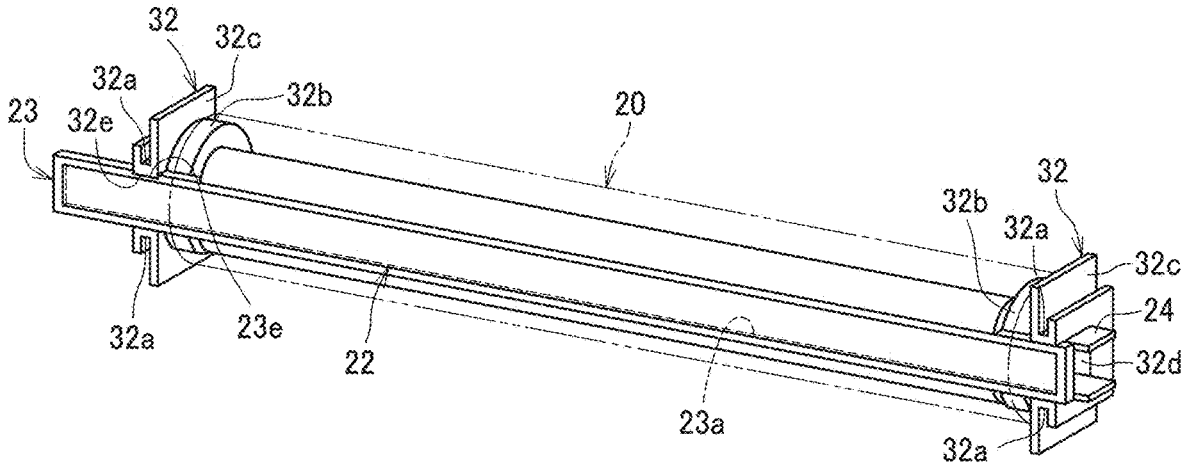
FIG. 6 is a perspective view of a heating unit incorporated in the fixing device of FIG. 3.
Figure 7:
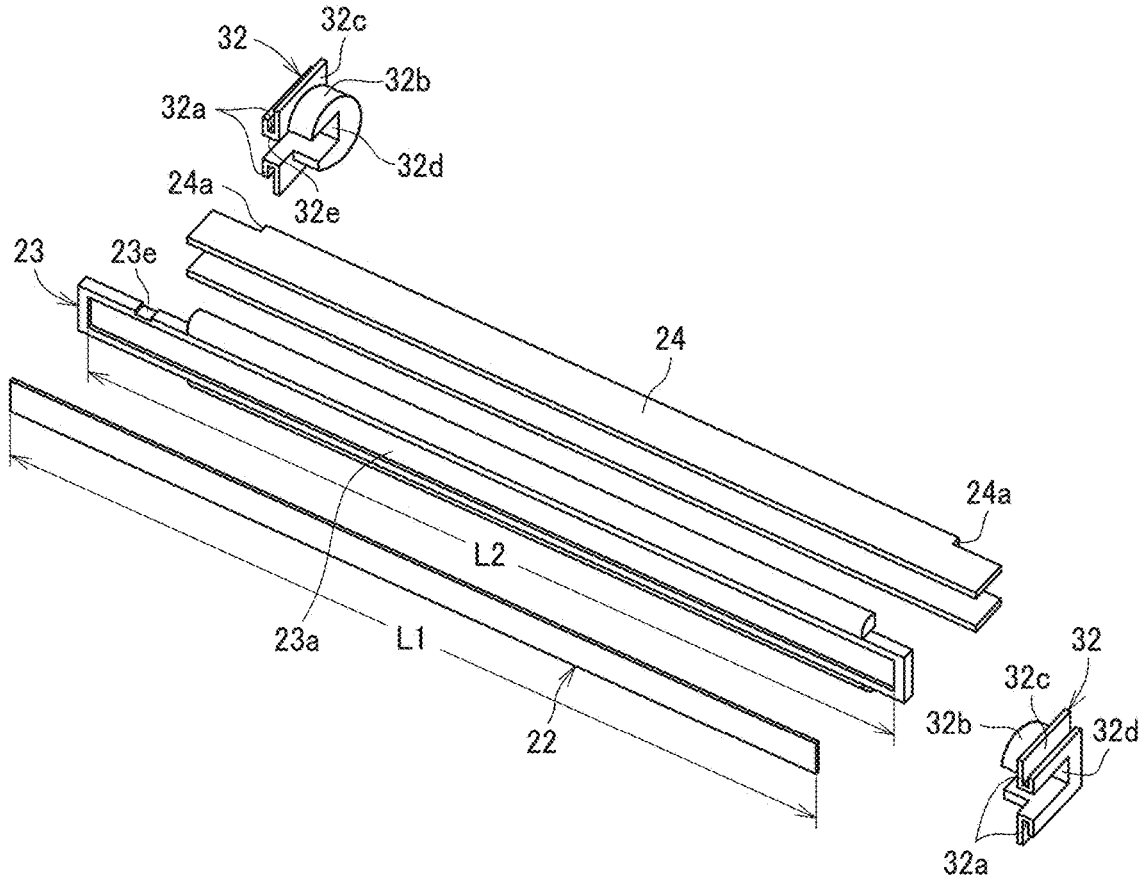
FIG. 7 is an exploded perspective view of the heating unit of FIG. 6.

FIG. 6 is a perspective view of a heating unit incorporated in the fixing device according to the present embodiment; and FIG. 7 is an exploded perspective view of the heating unit of FIG. 6.

As illustrated in FIGS. 6 and 7, the heater holder 23 includes an accommodating recess 23*a* disposed on a fixing belt side face of the heater holder 23. The fixing belt side face of the heater holder 23 is a front side face of the heater holder 23 in FIGS. 6 and 7. The accommodating recess 23*a* is rectangular and accommodates the heater 22. The accommodating recess 23*a* has substantially the same shape and size as the shape and size of the heater 22. Specifically, however, a length L2 of the accommodating recess 23*a* in the longitudinal direction of the heater holder 23 is slightly longer than a length L1 of the heater 22 in the longitudinal direction of the heater 22. The accommodating recess 23*a* formed slightly longer than the heater 22 does not interfere the heater 22 even when the heater 22 expands in the longitudinal direction due to thermal expansion. The accommodating recess 23*a* accommodates the heater 22, and the heater 22 is sandwiched by the heater holder 23 and a connector as a power supplying member described below, thus the heater 22 is held.

Each of the pair of supports 32 includes a C-shaped belt support 32*b*, a belt restrictor 32*c* as a flange, and a supporting recess 32*d*. The belt support 32*b* is inserted into both openings at both ends of the fixing belt 20 in the longitudinal direction of the fixing belt 20. As a result, the belt supports 32*b* support the fixing belt 20 by a free belt system that does not basically apply the fixing belt 20 with tension in a circumferential direction thereof while the fixing belt 20 does not rotate. On the other hand, the belt restrictor 32*c* is disposed to contact an end of the fixing belt 20 in the longitudinal direction of the fixing belt 20 and is not inserted into the loop of the fixing belt 20. The belt restrictor 32*c* contacts the end of the fixing belt 20 and restricts motion (e.g., skew) of the fixing belt 20 in the longitudinal direction of the fixing belt 20 even if the fixing belt 20 moves to one side in the longitudinal direction of the fixing belt 20. One of both ends of the heater holder 23 and one of both ends of the stay 24 are inserted into one of the supporting recesses 32*d*, and the other one of both ends of the heater holder 23 and the other one of both ends of the stay 24 are inserted into the other one of the supporting recesses 32*d*. Thus, the pair of supports 32 supports the heater holder 23 and the stay 24.

As illustrated in FIGS. 6 and 7, the heater holder 23 includes a positioning recess 23*e*, serving as a positioner, disposed at one lateral end of the heater holder 23 in the longitudinal direction thereof. The support 32 further includes an engagement 32*e* illustrated in a left part in FIGS. 6 and 7. The engagement 32*e* engages the positioning recess 23*e*, positioning the heater holder 23 with respect to the support 32 in the longitudinal direction of the fixing belt 20. The support 32 illustrated in right parts in FIGS. 6 and 7 does not include the engagement 32*e*. Therefore, the heater holder 23 is not positioned with respect to the support 32 in the longitudinal direction of the fixing belt 20. Positioning the heater holder 23 with respect to the support 32 at one side of the heater holder 23 in the longitudinal direction of the fixing belt 20 allows an expansion and contraction of the heater holder 23 in the longitudinal direction of the fixing belt 20 due to a temperature change.

As illustrated in FIG. 7, the stay 24 includes step portions 24*a* at both ends in the longitudinal direction of the stay 24. Each step portion 24*a* abuts the support 32 to restrict movement of the stay 24 in the longitudinal direction of the stay 24 with respect to the support 32. However, at least one of the step portions 24*a* is arranged to have a gap, that is, loose fit with play between the step portion 24*a* and the support 32. The above-described arrangement of the gap between the support 32 and at least one of the step portions 24*a* allows an expansion and contraction of the stay 24 in the longitudinal direction of the fixing belt 20 due to the temperature change.

Figure 8:
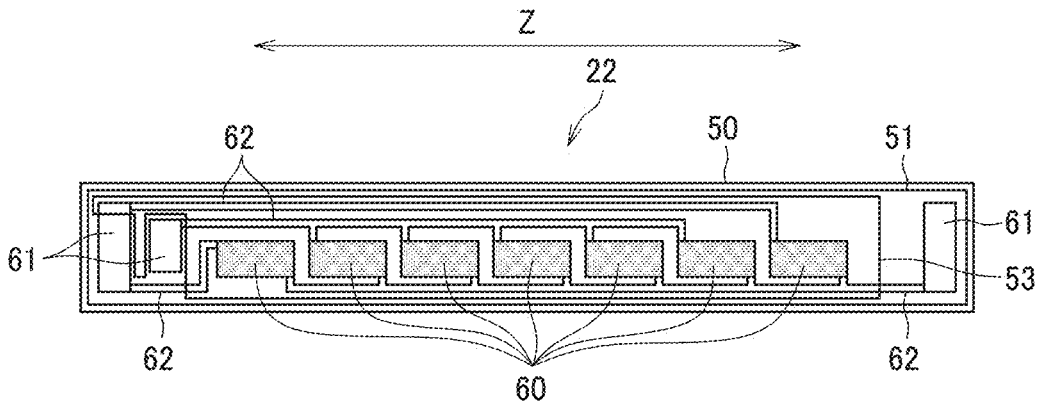
FIG. 8 is a plan view of a heater according to an embodiment of the present disclosure.
Figure 9:
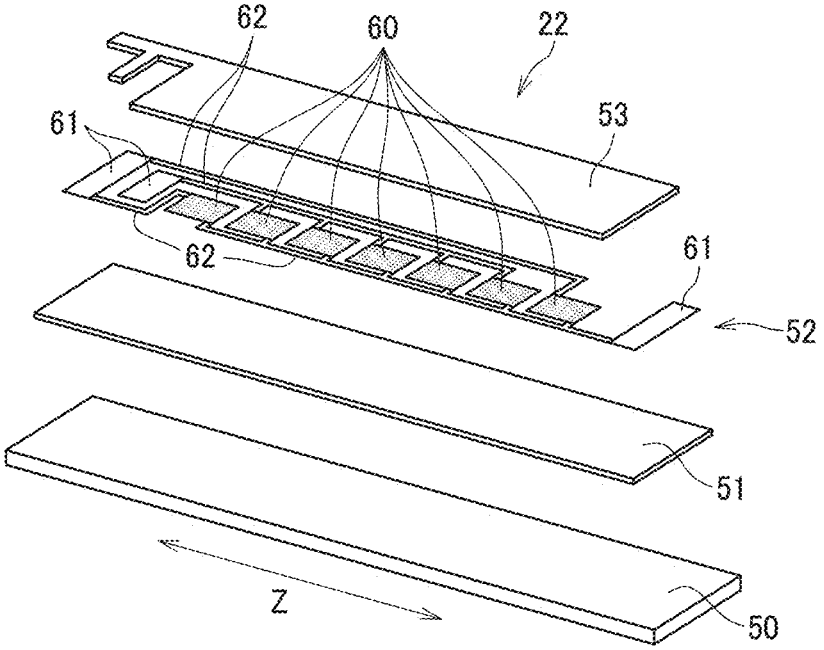
FIG. 9 is an exploded perspective view of the heater of FIG. 8.

FIG. 8 is a plan view of the heater 22 according to the present embodiment, and FIG. 9 is an exploded perspective view of the heater 22.

As illustrated in FIGS. 8 and 9, the heater 22 includes a base 50 that is a plate. A first insulation layer 51, a conductor layer 52, and a second insulation layer 53 are layered on the base 50. The base 50 longitudinally extends in a direction indicated by arrow Z in FIG. 8, that is, the longitudinal direction of the fixing belt 20 and the direction of the rotation axis of the pressure roller 21.

The base 50 is made of a metal material such as stainless steel (SUS), iron, or aluminum. The base 50 may be made of ceramic, glass, etc. instead of metal. The base 50 made of an insulating material such as ceramic allows omitting the first insulation layer 51 sandwiched between the base 50 and the conductor layer 52. In contrast, since metal has an excellent durability when it is rapidly heated and is processed readily, metal is preferably used to reduce manufacturing costs. Among metals, aluminum and copper are preferable because aluminum and copper have high thermal conductivity and are less likely to cause uneven temperature. Stainless steel is advantageous because the base 50 made of stainless steel is manufactured at reduced costs compared to aluminum and copper.

The first insulation layer 51 and the second insulation layer 53 are made of material having electrical insulation, such as heat-resistant glass, ceramic, or polyimide.

The conductor layer 52 includes a plurality of electrodes 61 and a plurality of power supply lines 62 as a plurality of conductors in addition to the plurality of resistive heat generators 60. Each of the resistive heat generators 60 is electrically coupled to any two of the three electrodes 61 via the plurality of power supply lines 62 disposed above the base 50. Thus, the resistive heat generators 60 are electrically coupled in parallel to each other.

For example, the resistive heat generators 60 are produced as below. Silver-palladium (AgPd), glass powder, and the like are mixed to make paste. The paste is screen-printed on the first insulation layer 51 layered on the base 50. Thereafter, the base 50 is subject to firing. Then, the resistive heat generators 60 are produced. The material of the resistive heat generator 60 may contain a resistance material, such as silver alloy (AgPt) or ruthenium oxide ($RuO_2$), other than the above material.

The electrodes 61 and the power supply lines 62 are made of conductors having an electrical resistance value smaller than the electrical resistance value of the resistive heat generators 60. Specifically, the electrodes 61 and the power supply lines 62 may be made of a material prepared with silver (Ag), silver-palladium (AgPd), or the like. Screen-printing such a material on the first insulation layer 51 disposed on the base 50 forms the electrodes 61 and the power supply lines 62.

As illustrated in FIG. 8, the heater 22 includes the second insulation layer 53 covering every resistive heat generators 60 and at least a part of the power supply lines 62 to ensure the insulation between them. In contrast, the second insulation layer 53 does not cover most of the electrodes 61 to expose the electrodes 61 so as to be connected to the connector.

Figure 10:
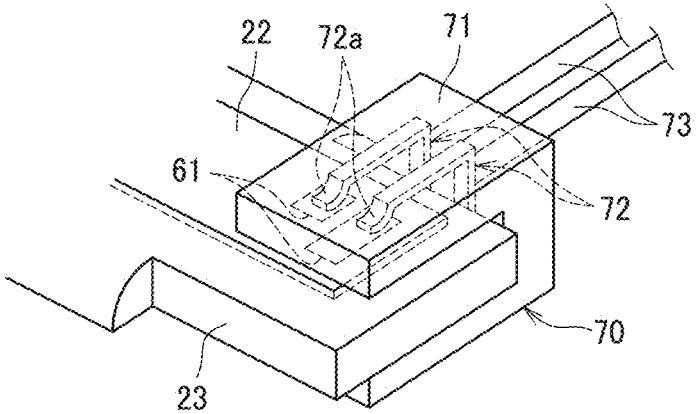
FIG. 10 is a perspective view of a connector connected to the heater of FIG. 8.

FIG. 10 is a perspective view of the connector connected to the heater according to the present embodiment.

As illustrated in FIG. 10, the connector 70 includes a housing 71 made of resin and a plurality of contact terminals 72. Each contact terminal 72 is an elastic member having conductivity such as a flat spring. Contact terminals 72 are disposed on the housing 71. Contact terminals 72 are coupled to harnesses 73 that supply power, respectively.

As illustrated in FIG. 10, the connector 70 is attached to the heater 22 and the heater holder 23 such that the connector 70 sandwiches the heater 22 and the heater holder 23 together. Thus, the connector 70 holds the heater 22 and the heater holder 23. Similarly, another connector 70 is connected to the electrode 61 located at another end of the heater 22 that is different from an end of the heater 22 on which the electrodes 61 illustrated in FIG. 10 are located. Contact portions 72*a* disposed at ends of the contact terminals 72 in the connector 70 elastically contact and press against the electrodes 61 each corresponding to the contact terminals 72 to electrically connect electrodes 61 and contact terminals 72, respectively. The above-described configuration enables a power supply disposed in the body of the image forming apparatus to supply power to the resistive heat generators 60. In other words, the power is supplied to each resistive heat generator 60 via the connectors 70, and each resistive heat generator 60 generates heat.

Figure 11:
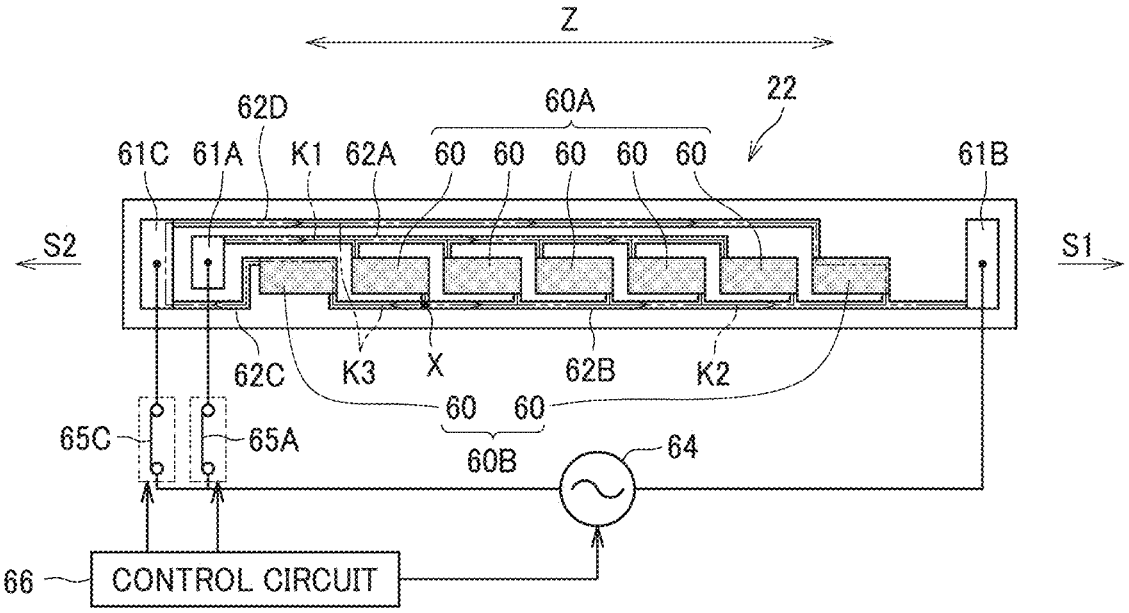
FIG. 11 is a schematic diagram illustrating a circuit to supply power to the heater of FIG. 8.

As illustrated in FIG. 11, in the present embodiment, the resistive heat generators 60 are arranged in the longitudinal direction of the base 50 and includes a first resistive heat generator group 60A serving as a first heat generation part and a second resistive heat generator group 60B serving as a second heat generation part. The first resistive heat generator group 60A includes the resistive heat generators 60 other than the resistive heat generators 60 above both ends of the base 50. The second resistive heat generator group 60B includes the resistive heat generators 60 above both ends of the base 50. The first resistive heat generator group 60A and the second resistive heat generator group 60B are separately controllable to generate heat. Specifically, each of the resistive heat generators 60 of the first resistive heat generator group 60A (i.e., the resistive heat generators 60 other than the resistive heat generators 60 above both ends of the base 50) is connected, through a first power supply line 62A, to a first electrode 61A above a first longitudinal end of the base 50. In addition, each of the resistive heat generators 60 of the first resistive heat generator group 60A is also connected, through a second power supply line 62B, to a second electrode 61B above a second longitudinal end of the base 50 that is the other end of the first longitudinal end of the base 50 above which the first electrode 61A is disposed. On the other hand, each of the resistive heat generators 60 of the second resistive heat generator group 60B (i.e., the resistive heat generators 60 above both ends of the base 50) is connected, through a third power supply line 62C or a fourth power supply line 62D, to a third electrode 61C (that is different from the first electrode 61A) above the first longitudinal end of the base 50. Like each of the resistive heat generators 60 of the first resistive heat generator group 60A, each of the second resistive heat generator group 60B is also connected to the second electrode 61B through the second power supply line 62B.

Connecting the connector 70 described above to the electrodes 61A to 61C enables a power supply 64 to supply power to each resistive heat generator 60. A switch 65A as a switching unit is disposed between the first electrode 61A and the power supply 64, and a switch 65C as a switching unit is disposed between the third electrode 61C and the power supply 64. A control circuit 66 controls ON and OFF of these switches 65A and 65C and timing of power supply to the heater 22. For example, the control circuit 66 controls ON and OFF of each of the switches 65A and 65C based on detection results of various sensors such as a sheet size sensor in the image forming apparatus 100.

Applying a voltage to the first electrode 61A and the second electrode 61B generates an electric potential difference between the first electrode 61A and the second electrode 61B, and a current flows the resistive heat generators 60 other than the resistive heat generators at both ends. As a result, the first resistive heat generator group 60A generates heat alone. Similarly, applying a voltage to the second electrode 61B and the third electrode 61C generates an electric potential difference between the second electrode 61B and the third electrode 61C, and a current flows the resistive heat generators 60 at both ends. As a result, the second resistive heat generator group 60B generates heat alone. When a voltage is applied to all the first to third electrodes 61A to 61C, the resistive heat generators 60 of both the first resistive heat generator group 60A and the second resistive heat generator group 60B (i.e., all the resistive heat generators 60) generate heat. For example, the first resistive heat generator group 60A generates heat alone to fix the toner image on a sheet P having a relatively small width conveyed, such as the sheet P of A4 size (sheet width: 210 mm) or a smaller sheet P. By contrast, the second resistive heat generator group 60B generates heat together with the first resistive heat generator group 60A to fix a toner image on a sheet P having a relatively large width conveyed, such as a sheet P of A3 size (sheet width: 297 mm) or a larger sheet P. As a result, the heater 22 can generate heat in a heat generation area corresponding to a sheet width.

Generally, the power supply line slightly generates heat when the resistive heat generator generates heat in the heater including the resistive heat generators above the base as described above. The heat generation distribution of the power supply lines may cause the temperature variation in the temperature distribution of the heater. In particular, increasing currents flowing through the resistive heat generators to increase heat generation amount in response to speeding up the image forming apparatus increases the amounts of heat generated in the power supply lines. As a result, affection by the heat generated in the power supply lines cannot be ignored.

Figure 12:
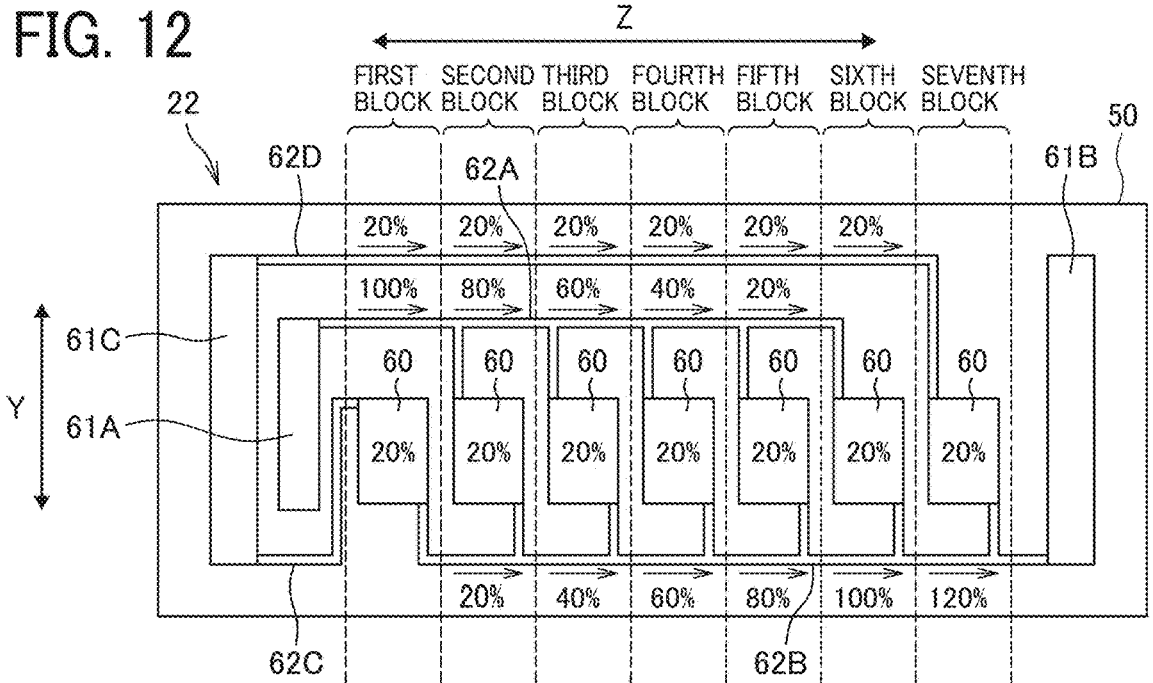
FIG. 12 is a diagram including a schematic top view of the heater of FIG. 8, a table, and a graph illustrating an uneven temperature distribution generated in the heater when all resistive heat generators of the heater are energized.
Figure 12:
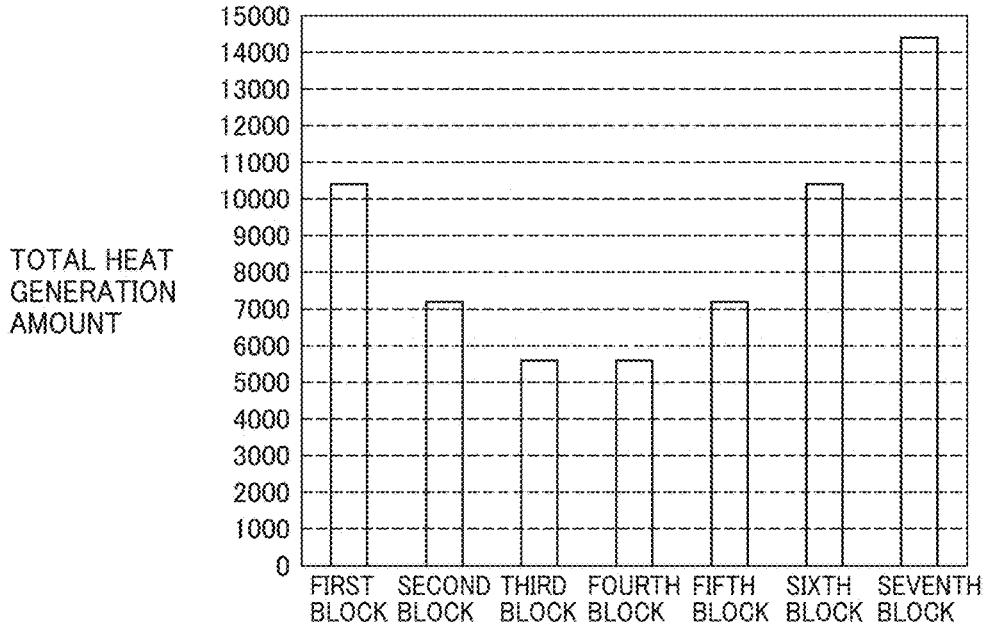
Figure 13:
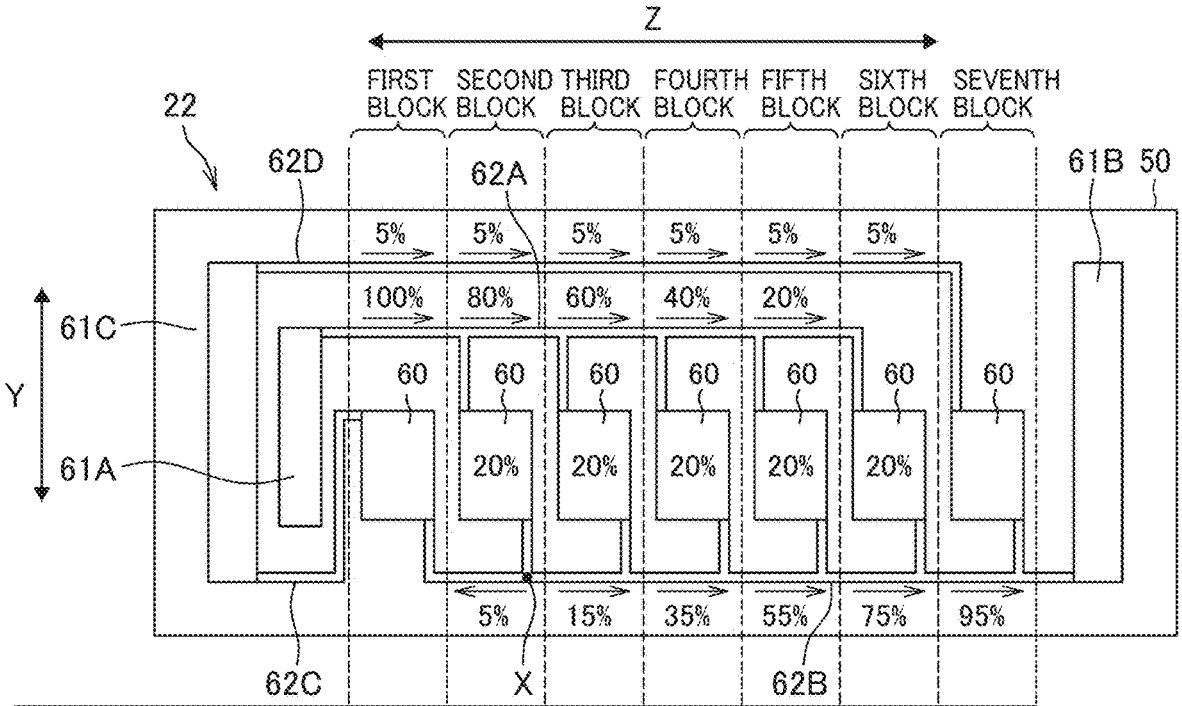
FIG. 13 is a diagram including a schematic top view of the heater of FIG. 8, a table, and a graph illustrating an uneven temperature distribution generated in the heater when the resistive heat generators other than the resistive heat generators at both ends are energized.
Figure 13:
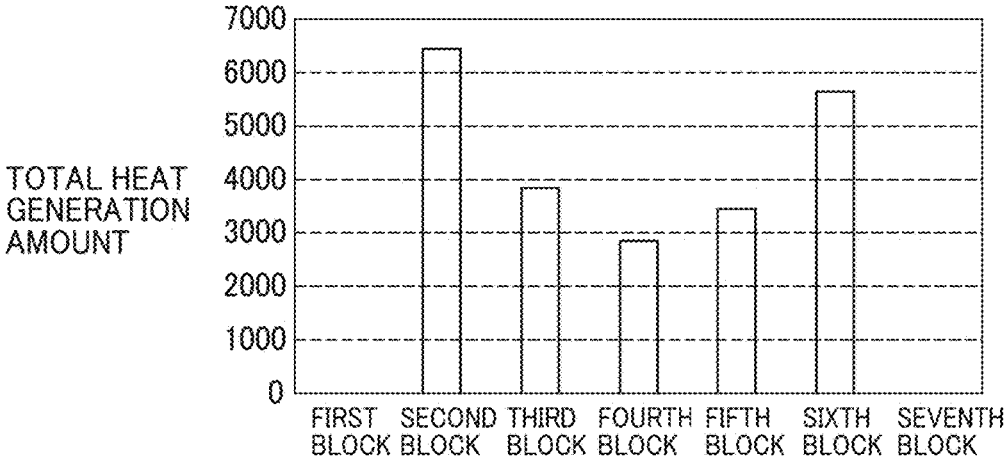

With reference to FIGS. 12 and 13, the following describes a temperature distribution variation (a temperature distribution deviation) occurring in the heater 22 according to the present embodiment.

FIG. 12 illustrates blocks separated so as to include each of the resistive heat generators 60 and heat generation amounts generated by each of the power supply lines 62A, 62B, and 62D and a total heat generation amount in each block when the current with the same value flows through each of the resistive heat generators 60. The current value is simply referred to as 20%. Based on a relation between a heat generation amount (W) and a current (I) represented by the following equation (1), each of the heat generation amounts indicated in the table of FIG. 12 is calculated as the square of the current (I) flowing through each of the power supply lines. Therefore, the numerical values of the heat generation amounts indicated in the table of FIG. 12 are merely values calculated simply and are different from the actual heat generation amounts. Since a length of each of the power supply lines 62A, 62B, and 62D extending in the short-side direction of the heater 22 (that is the direction indicated by arrow Y in FIG. 12) is relatively shorter than a length of each of the power supply lines 62A, 62B, and 62D extending in the longitudinal direction of the heater 22 (that is the direction indicated by arrow Z in FIG. 12), a heat generation amount generated in a portion of each of the power supply lines 62A, 62B, and 62D extending in the short-side direction is relatively small. Therefore, the heat generation amount generated in the portion of each of the power supply lines 62A, 62B, and 62D extending in the short-side direction is eliminated in the table of FIG. 12. The table illustrated in FIG. 12 simply indicates the calculated heat generation amounts generated in a portion of each of power supply lines 62A, 62B, and 62D extending in the longitudinal direction of the heater 22. The short-side direction of the heater 22 means a direction (that is, the direction Y) intersecting the longitudinal direction (that is, the direction Z) along the surface of the first insulation layer 51 on which the resistive heat generators 60 are disposed.

Equation 1

$$W=R\times I^2 \quad (1)$$

where W represents the heat generation amount, R represents the resistance, and I represents the current.

With continued reference to FIG. 12, a description is given of a specific way of calculating the heat generation amount for the first and second blocks, for example. In the first block in FIG. 12, a proportion of a current flowing through the fourth power supply line 62D to the current flowing through the first power supply line 62A is 20%, and the proportion of the current flowing through the first power supply line 62A is expressed as 100%. Therefore, the total heat generation amount generated by the power supply lines 62A and 62D in the first block is expressed as 10400, which is the total value of the square of the current flowing through the first power supply line 62A that is 100 (i.e., the square is 10000) and the square of the current flowing through the fourth power supply line 62D that is 20 (i.e., the square is 400). In the second block in FIG. 12, a proportion of a current flowing through the first power supply line 62A is 80%, a proportion of a current flowing through the second power supply line 62B is 20%, and a proportion of a current flowing through the fourth power supply line 62D is 20%. Therefore, the total heat generation amount generated by the power supply lines 62A, 62B, and 62D in the second block is expressed as 7200, which is the total value of the square of the current flowing through the first power supply line 62A that is 80 (i.e., the square is 6400), the square of the current flowing through the second power supply line 62B that is 20 (i.e., the square is 400), and the square of the current flowing through the fourth power supply line 62D that is 20 (i.e., the square is 400), that is, 6400+400+400=7200. The heat generation amounts in other blocks are similarly calculated.

The y-axis in the graph in FIG. 12 represents the total heat generation amounts described above in the blocks. As can be seen from this graph, the total heat generation amount generated by the power supply lines in each of blocks disposed both ends (i.e., the first block and a seventh block) is larger than the total heat generation amount of each of blocks disposed on a center portion of the heater 22 (i.e., a third block and a fourth block). The above-described variation in the heat generation distribution generated by the power supply lines over the longitudinal direction Z of the heater 22 causes the variation in the temperature distribution of the heater 22.

The temperature variation caused by the above-described variation in the heat generation distribution generated by the power supply lines may occur not only when all the resistive heat generators generate heat as described in FIG. 12 but also when a part of the resistive heat generators generate heat. In particular, when downsizing the heater or increasing a print speed of the image forming apparatus causes an unintended shunt in the power supply line, the temperature variation may become significant. The unintended shunt easily occurs when reducing a width of the power supply lines in the short-side direction of the heater to downsize the heater in the short-side direction increases the resistance values of the power supply lines. In addition, the unintended shunt easily occurs when the resistance values of the resistive heat generators are set to be small to increase the heat generation amounts of the resistive heat generators to increase the print speed of the image forming apparatus. That is, when the resistance value of the power supply line and the resistance value of the resistive heat generator are relatively close to each other in accordance with at least one of increasing the resistance values of the power supply lines or small resistance values of the resistive heat generators, a current may flow through a path through which the current did not flow before, that is, the unintended shunt may occur.

For example, as illustrated in FIG. 13, unintended shunt occurs when a current flows through the resistive heat generators 60 other than the resistive heat generators 60 disposed at both ends. Specifically, a proportion of a current flowing through each of the resistive heat generators 60 other than the resistive heat generators 60 at both ends to a total current is 20% in this example. However, 5% of the current passing through the second resistive heat generator 60 from the left in FIG. 13 flows from a branch X of the second power supply line 62B toward the left side in FIG. 13 in a direction opposite a direction toward the second electrode 61B. As a result, a shunted current occurs. The shunted current then passes through the resistive heat generator 60 on the left end in FIG. 13 and further passes through the third power supply line 62C, the third electrode 61C, the fourth power supply line 62D, and the resistive heat generator 60 on the right end in FIG. 13 in this order. Finally, the current joins the second power supply line 62B. In the examples in FIGS. 12 and 13, the current flows in one direction, but the present disclosure is not limited to this. The current flowing through the heater 22 may be alternating current.

A table and a graph in FIG. 13 illustrate heat generation amounts generated by each of the first power supply line 62A, the second power supply line 62B, and the fourth power supply line 62D and their total heat generation amounts in each of the blocks of the heater 22 flowing the unintended shunt. The method of calculating the heat generation amount is the same as the method described in the example in FIG. 12. For the same reason as in the example illustrated in FIG. 12, the heat generation amount of the portion extending in the short-side direction (that is the direction indicated by arrow Y) of each of the power supply lines 62A, 62B, and 62D is omitted in the example illustrated in FIG. 13.

As can be seen from the table and the graph in FIG. 13, the total heat generation amounts generated by the power supply lines in both end blocks (that is, the second block and the sixth block) are also larger than the total heat amount of the center block (that is, the fourth block) in this case, and the variation in the temperature distribution due to the power supply lines occurs. However, contrary to the graph in FIG. 12, the total heat generation amount in the left end block is larger than the total heat generation amount in the right end block in the graph in FIG. 13. As a result, a temperature in the left end block is higher than a temperature in the right end block.

As described above, the difference between the heat generation amounts generated by the power supply lines in blocks causes an uneven temperature distribution of the heater over the longitudinal direction in the heater according to the present embodiment. The above-described uneven temperature distribution of the heater affects not only the fixing device but also other devices in the image forming apparatus.

Specifically, the image forming apparatus according to the present embodiment includes the process unit 1Y near the fixing device 9 as illustrated in FIG. 1, and the uneven temperature distribution of the heater affects the process unit 1Y. In addition, since the intermediate transfer belt 11 rotates and transmits the heat of the process unit 1Y close to the fixing device 9 to the other process units 1M, 1C, and 1Bk, the other process units 1M, 1C, and 1Bk are influenced to no small degree by the uneven temperature distribution of the heater.

As a result, the temperature distribution of the cleaning blade 77 in each of the process units 1Y, 1M, 1C, and 1Bk becomes uneven, and the cleaning performance of the cleaning blade 77 may be deteriorated particularly at a high temperature portion of the cleaning blade 77. Hereinafter, the principle of deterioration in the cleaning performance of the cleaning blade 77 is described.

Figure 14:
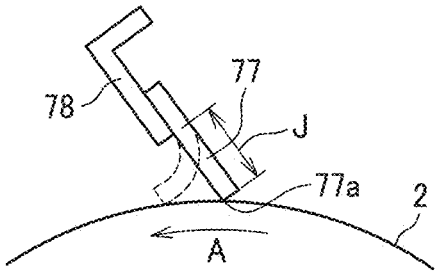
FIG. 14 is a schematic diagram illustrating a principle of deterioration of cleaning performance.

As illustrated in FIG. 14, the cleaning blade 77 is generally set to be in contact with the photoconductor 2 in a counter direction with respect to a rotation direction A (a surface movement direction) of the photoconductor 2. The blade holder 78 holds the cleaning blade 77 in a cantilever manner. The counter direction is defined as a direction in which the tip end (that is a free end) of the cleaning blade 77 is located upstream from the rear end of the cleaning blade 77 (that is an end supported by the blade holder 78) in a rotation direction of the photoconductor 2. As the photoconductor 2 rotates, the cleaning blade 77 rubs against the surface of the photoconductor 2. Although force in the rotation direction A of the photoconductor 2 acts on the tip end as a rubbing portion 77*a* of the cleaning blade 77 as illustrated in FIG. 14, the cleaning blade 77 is normally held in the counter direction.

However, when the above-described uneven temperature distribution of the heater affects the temperature distribution of the cleaning blade 77 to be uneven, the uneven temperature distribution of the cleaning blade 77 generates a high temperature portion of the cleaning blade 77 having a high rebound resilience with respect to the photoconductor 2. The high rebound resilience increases the friction force between the cleaning blade 77 and the photoconductor 2. The high friction force between the cleaning blade 77 and the photoconductor 2 and the force of the photoconductor 2 in the rotation direction A of FIG. 14 cause so-called curling in which the tip of the cleaning blade 77 is reversed as indicated with a dashed line in FIG. 14.

As described above, the temperature distribution of the heater affects the temperature distribution of the cleaning blade 77 to generate the high temperature portion of the cleaning blade 77 that may cause the curling. The occurrence of the curling of the cleaning blade 77 prevents maintaining a suitable contact state of the cleaning blade 77 with respect to the photoconductor 2 and deteriorates the cleaning performance of the cleaning blade 77.

In the present embodiment, the following measures are taken so as to prevent the curling of the cleaning blade 77 and maintain the suitable contact state of the cleaning blade 77 with respect to the photoconductor 2.

Figure 15:
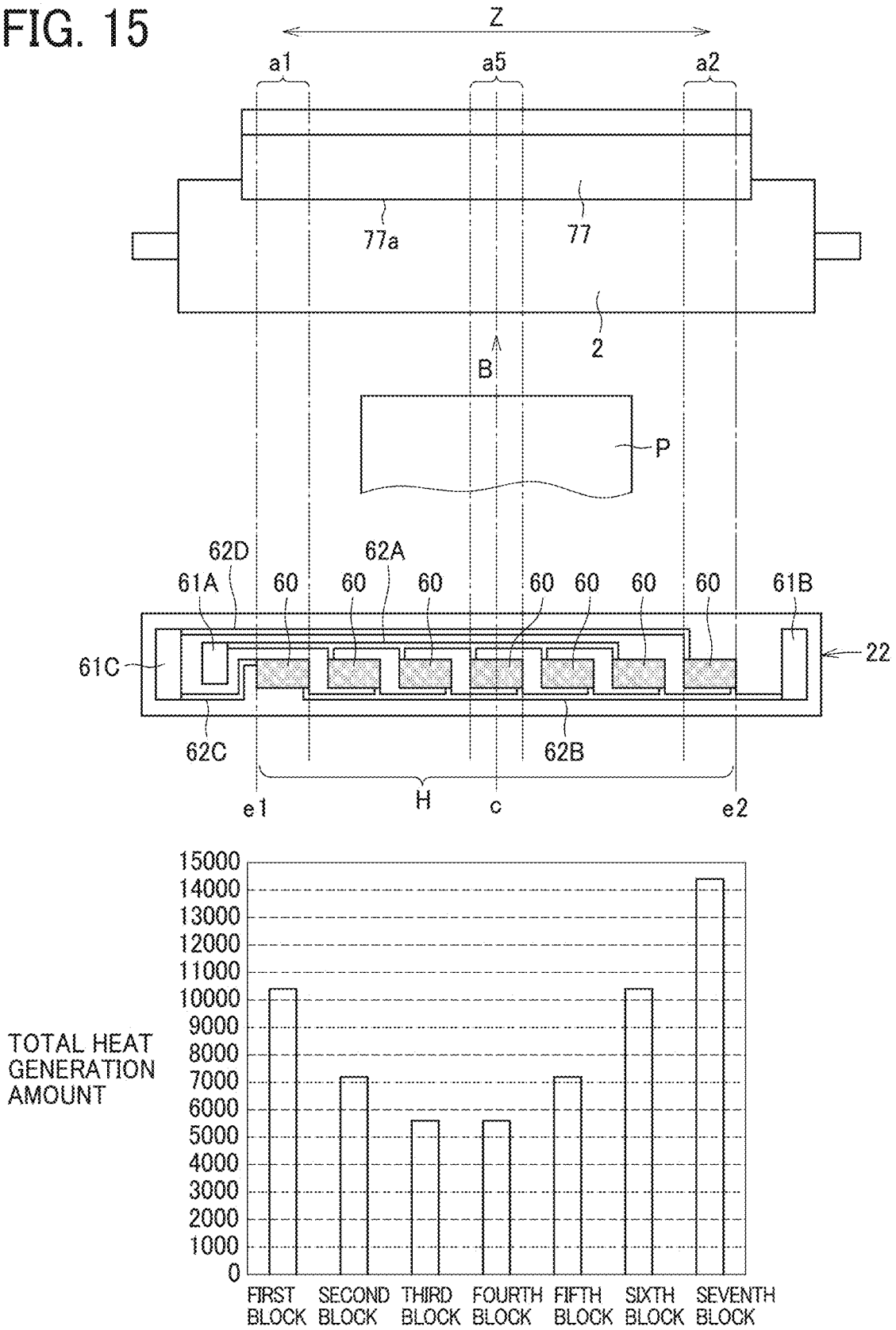
FIG. 15 is a diagram illustrating an uneven temperature distribution of a cleaning blade when all resistive heat generators of the heater are energized as illustrated in FIG. 12.

Firstly, the following describes the temperature distribution of the cleaning blade according to the present embodiment with reference to FIG. 15.

As illustrated in FIG. 15, the cleaning blade 77 extends in a longitudinal direction of the photoconductor 2 or in a direction of a rotation axis of the photoconductor 2, that is, in a direction indicated by arrow Z in FIG. 15. In the above-described configuration, the rubbing portion 77*a* that is a portion of the cleaning blade 77 rubbing the photoconductor 2 also extends in the direction indicated by the arrow Z. The longitudinal direction of the cleaning blade 77 is the same as the longitudinal direction of the heater 22. In other words, both the cleaning blade 77 and the heater 22 extend in a sheet width direction (that is the direction indicated by the arrow Z). The above-described term the "sheet width direction (in other words, a recording medium width direction)" means a direction parallel to a sheet surface and orthogonal to the sheet conveyance direction B (a recording medium conveyance direction) in FIG. 15. In addition, the "sheet surface" means a surface having the largest area among surfaces of the sheet in three directions intersecting each other.

As described above, since both the cleaning blade 77 and the heater 22 extend longitudinally in the same direction Z (the direction orthogonal to the sheet conveyance direction), the temperature distribution over the longitudinal direction of the heater 22 influences the temperature distribution in the longitudinal direction of the cleaning blade 77. Both the rubbing portion 77*a* of the cleaning blade 77 rubbing the photoconductor 2 and a heat generation area H in which the resistive heat generators 60 of the heater 22 are disposed have substantially the same lengths (lengths in a direction orthogonal to the sheet conveyance direction) and are disposed over a range including the maximum sheet width or the maximum image formation area width. The developing device 4 and the like are disposed between the rubbing portion 77*a* and the heater 22. Accordingly, both ends of the rubbing portion 77*a* in the longitudinal direction and both ends of the heater 22 in the longitudinal direction are indirectly facing each other. The temperature distribution of the heater 22 influences the intermediate transfer belt 11, the developing device 4, and the like near the heater 22, and the influence also affects the cleaning blade 77. The temperature distribution of the heater 22 influences the cleaning blade 77 such that a temperature of an end of the rubbing portion 77*a* becomes higher than a temperature of a center portion of the rubbing portion 77*a* in the longitudinal direction Z (that is the direction orthogonal to the sheet conveyance direction).

Note that "the end of the rubbing portion 77*a* of the cleaning blade 77 faces the end of the heater 22" in the present embodiment means that the end of the rubbing portion 77*a* is at a position at which the heat of the end of the heater 22 affects a function of the end of the rubbing portion 77*a*. For example, the end of the rubbing portion 77*a* faces the end of the heater 22 when the end of the rubbing portion 77*a* is substantially at the same position as the end of the heater 22 in the longitudinal direction of the heater 22.

The graph in FIG. 15 illustrates the temperature distribution of the heater 22 when all the resistive heat generators 60 included in the heater 22 generate heat. In this case, the temperatures in the first block and the seventh block of the heater 22 on both ends e1 and e2 of the heat generation area H in the longitudinal direction are higher than other temperatures in the heat generation area H in which the resistive heat generators 60 are disposed. As a result, temperatures of portions a1 and a2 of the cleaning blade 77 facing both ends e1 and e2 in the longitudinal direction of the heat generation area H of the heater 22 are higher than a temperature of a portion a5 of the cleaning blade 77 facing the longitudinal center c of the heat generation area H of the heater 22, as illustrated in FIG. 15.

Figure 16:
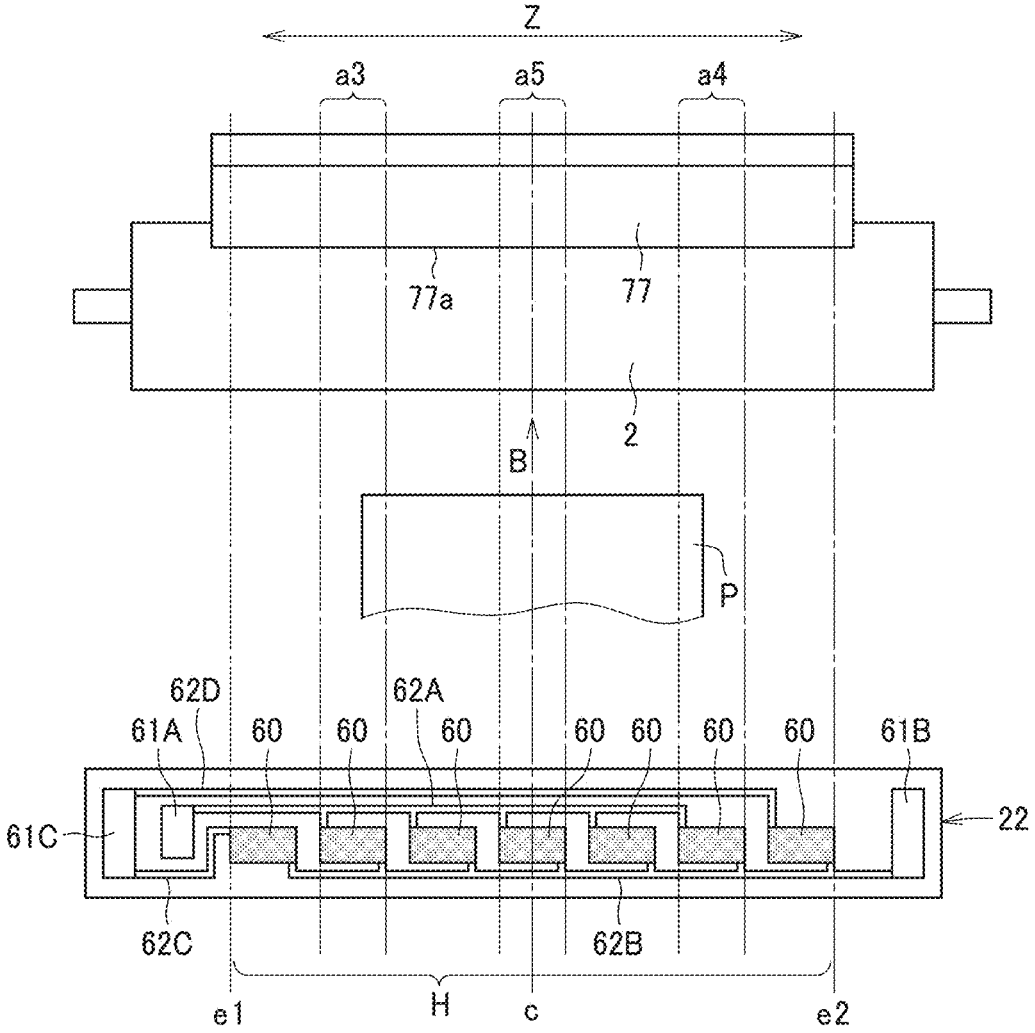
FIG. 16 is a diagram illustrating an uneven temperature distribution of the cleaning blade when the resistive heat generators other than the resistive heat generators at both ends are energized as illustrated in FIG. 13.
Figure 16:
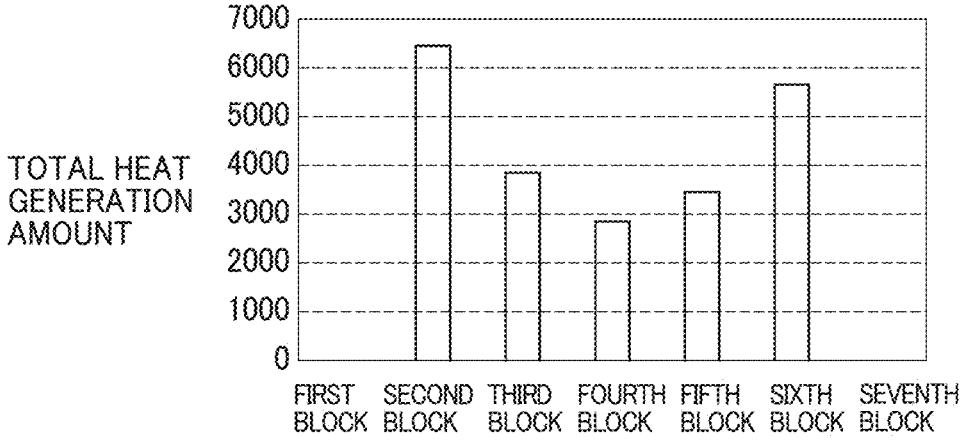

The graph in FIG. 16 illustrates the temperature distribution of the heater 22 when the first resistive heat generator group (that is, the resistive heat generators 60 other than the resistive heat generators at both ends) included in the heater 22 generate heat. In this case, the temperatures in the second block and the sixth block of the heater 22 near both ends e1 and e2 of the heat generation area H in the longitudinal direction are higher than other temperatures in the heat generation area H of the heater 22. As a result, temperatures of portions a3 and a4 of the cleaning blade 77 facing both ends e1 and e2 in the longitudinal direction of the heat generation area H of the heater 22 are higher than the temperature of the portion a5 of the cleaning blade 77 facing the longitudinal center c of the heat generation area H of the heater 22, as illustrated in FIG. 16.

As described above, the cleaning blade 77 according to the present embodiment tends to have the temperatures at both ends higher than the temperature at the center portion in the longitudinal direction under the heat generation distributions illustrated in FIGS. 15 and 16. For this reason, the cleaning blade 77 according to the present embodiment is designed so that friction forces between photoconductor 2 and both ends of the rubbing portion 77*a* are smaller than a friction force between the photoconductor 2 and the center portion of the rubbing portion 77*a* in the longitudinal direction in order to prevent the curling of the cleaning blade 77. In the above description, the friction force between the photoconductor 2 and the portion of the rubbing portion 77*a* facing the heater 22 is set. In other words, the cleaning blade 77 in the present embodiment is configured to have a small friction force between photoconductor 2 and a portion of the rubbing portion 77*a* corresponding to a high temperature portion of the heater 22. The high temperature portion of the heater 22 is a high heat generation portion of heater 22, in the present embodiment, each of both ends of the heater 22. The heater 22 in the above-described embodiment generates a larger heat amount at both ends than another portion. When the heater 22 generates a larger heat amount at one end than another portion, the cleaning blade 77 is configured to have a smaller friction force at one end of the rubbing portion 77*a* facing the one end of the heater 22 than another portion of the rubbing portion 77*a*.

In general, the friction force between the cleaning blade and the photoconductor includes a static friction force (a maximum static friction force) generated at the moment when the photoconductor starts rotating and a dynamic friction force generated while the photoconductor rotates after the photoconductor starts rotating. The curling of the cleaning blade may occur both at the moment when the photoconductor starts rotating and thereafter while the photoconductor is rotating. In order to reliably prevent the curling of the cleaning blade in each case, it is preferable to reduce both the static friction force and the dynamic friction force. However, since the image forming apparatus in the present embodiment has an advantage if the configuration in the present embodiment can prevent at least one of the curling occurring when photoconductor starts rotating and the curling occurring while the photoconductor is rotating, the friction force in the present specification means at least one of the static friction force and the dynamic friction force.

As described above, the rubbing portion 77*a* in which the cleaning blade 77 according to the present embodiment rubs the photoconductor 2 according to the present embodiment includes longitudinal both ends facing the high temperature portions of the heater 22. The friction forces between the cleaning blade 77 and the photoconductor 2 on the longitudinal both ends are smaller than the friction force on another portion of the cleaning blade 77. Therefore, the curling of the cleaning blade 77 caused by rotation of photoconductor 2 can be effectively prevented even if the temperature distribution of the heater 22 affects the cleaning blade. As a result, the above-described configuration can maintain an appropriate contact state of the cleaning blade 77 with respect to the photoconductor 2 and ensure good cleaning performance.

In order to ensure the good cleaning performance, it is preferable to prevent the curling of the cleaning blade 77 under the heat generation distributions illustrated in FIGS. 15 and 16. Under the heat generation distributions illustrated in FIGS. 15 and 16, temperatures of the first, seventh, second, and sixth blocks are higher than the temperature of the fourth block at the center of the heater 22. Accordingly, friction forces between the photoconductor 2 and portions a1, a2, a3, and a4 of the cleaning blade 77 facing the first, seventh, second, and sixth blocks of the heater 22, respectively are designed to be smaller than a friction force between the photoconductor 2 and a portion a5 of the cleaning blade 77 at the center of the cleaning blade 77.

However, the portion or a range of the cleaning blade 77 in which the friction force is reduced may be appropriately changed. For example, the friction forces between the photoconductor 2 and only the portions a1 and a2 of the cleaning blade 77 facing the first and seventh block of the heater 22, respectively may be designed to be smaller than a friction force between the photoconductor 2 and another portion of the cleaning blade 77 to prevent the curling of the cleaning blade 77 under the heat generation distribution illustrated in FIG. 15 in which the variation in the temperature distribution is particularly significant. The friction force may not be set for each block in which the resistive heat generator 60 is disposed. For example, the friction force may be changed continuously or stepwise in one block.

A portion of the cleaning blade 77 on which the curling may occur corresponds to the high temperature portion of the heater 22, and the high temperature portion of the heater 22 may be identified by comparison between the heat generation amounts of portions of the heater 22 in the longitudinal direction of the heater 22 (that is the same as the sheet width direction). Note that "the heat generation amounts of portions of the heater 22 in the longitudinal direction of the heater 22" include the heat generation amounts generated by the power supply lines 62 in addition to the heat generation amounts generated by the resistive heat generators 60.

As illustrated in the above-described equation (1), since the heat generation amount (W) is proportional to the square of the current (I), a magnitude relation between the heat generation amounts of the heater 22 may be identified by using a sum of the square of the currents flowing through the power supply lines 62A, 62B, and 62D. In the above description, since the "currents flowing through the power supply lines 62A, 62B, and 62D" are currents used to specify the magnitude relationship of the heat generation amounts of the heater 22, the above "currents flowing through the power supply lines 62A, 62B, and 62D" do not include the currents flowing through the power supply lines 62A, 62B, and 62D in regions including the resistive heat generators 60 at both ends that do not generate heat as in the example illustrated in FIG. 16. In other words, the "current flowing through the power supply lines 62A, 62B, and 62D" used to specify the magnitude relationship of the heat generation amounts of the heater 22 means currents flowing through the power supply lines 62A, 62B, 62D in a region including the resistive heat generator 60 that generates heat. Strictly speaking, the resistive heat generators 60 at both ends generate heat in the example illustrated in FIG. 16 because the unintended shunt that is a little current flows through the resistive heat generators 60 at both ends (see FIG. 13). However, the above-described "resistive heat generator 60 that generates heat" means the resistive heat generators 60 that are normally energized to generate heat. Therefore, the region including the resistive heat generator 60 through which the unintended shunt flows to slightly generate heat is not considered as the region to specify the magnitude relationship of the heat generation amounts.

Specifically, the following describes structures to reduce the friction force between the cleaning blade 77 and the photoconductor 2.

Initially, the friction force is described. As illustrated in the following equation (2), the friction force (F) between the cleaning blade and the photoconductor is obtained by multiplying a friction coefficient (μ) between the photoconductor and the cleaning blade by the contact pressure (N) of the cleaning blade with respect to the photoconductor.

Equation 2

$$F=\mu\times N \tag{2}$$

Therefore, according to the equation (2), the friction force (F) of the cleaning blade can be reduced by reducing the contact pressure (N) of the cleaning blade pressing the photoconductor. The contact pressure (N) of the cleaning blade 77 is changed by a free length J (see FIG. 14) that is a length of a portion of the cleaning blade 77 protruding from the blade holder 78 toward the photoconductor 2. That is, as the free length J of the cleaning blade 77 is longer, the cleaning blade 77 is more easily bent, and thus the contact pressure of the cleaning blade 77 with respect to the photoconductor 2 becomes smaller.

Figure 17:
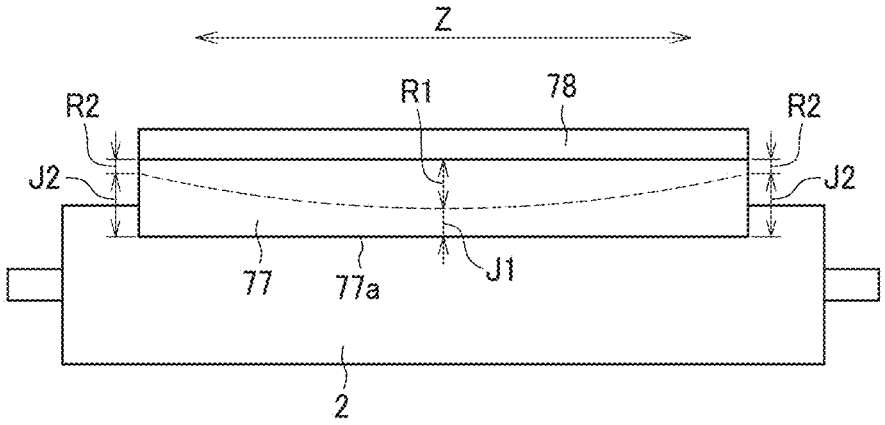
FIG. 17 is a schematic front view of a cleaning blade having different free lengths between a center and each end.

Therefore, as in the example illustrated in FIG. 17, setting free lengths of both ends of the cleaning blade 77 in the longitudinal direction (the direction indicated by arrow Z in FIG. 17) longer than a free length of the central portion of the cleaning blade 77 (J1<J2) can reduce the friction forces between the photoconductor and both ends of the cleaning blade 77 at which the curling is likely to occur.

In the example illustrated in FIG. 17, the length of a part of the blade holder 78 to hold the cleaning blade 77 is continuously changed from the center (the length is R1) to both ends (the length is R2) in the longitudinal direction. In other words, in this case, the length R2 of the part of the blade holder 78 holding the cleaning blade 77 at both ends is set shorter than the length R1 of the part of the blade holder 78 holding the cleaning blade 77 at the center (that is, R1>R2) to set the free lengths of both ends of the cleaning blade 77 longer than the free length of the center of the cleaning blade 77.

Figure 18:
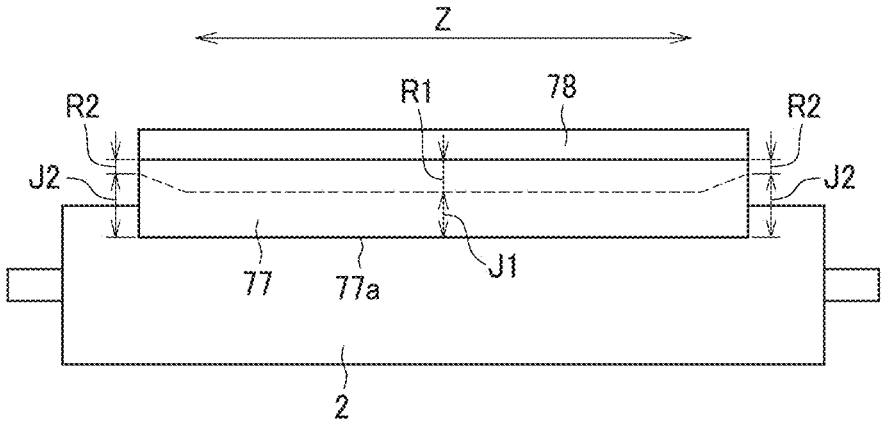
FIG. 18 is a schematic front view of a variation of the cleaning blade of FIG. 17 held by a blade holder.
Figure 19:
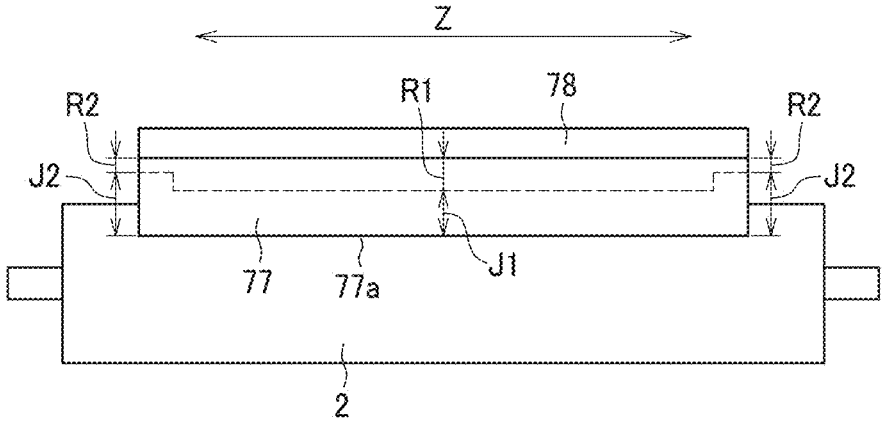
FIG. 19 is a schematic front view of the cleaning blade held by a blade holder according to another variation of FIG. 17.

The shape of the blade holder 78 may be appropriately changed. For example, an example as illustrated in FIG. 18 or 19 may be employed. In the example illustrated in FIG. 18 or 19, the lengths R2 of the parts holding the cleaning blade 77 on the blade holder 78 in both ends of the blade holder 78 having a certain length from both sides of the blade holder 78 in the longitudinal direction in which the curling is likely to occur is set shorter than the length R1 of the part holding the cleaning blade 77 on the blade holder 78 at the center of the blade holder 78 (that is, R1>R2). The above-described structure can reduce a manufacturing cost of the blade holder 78 because both ends of the blade holder 78 having the certain length from both ends in the longitudinal direction is processed to be short, and another portion is not processed. The tip shape of each of both ends of the blade holder 78 having the certain length from both ends in the longitudinal direction may be a shape inclined with respect to the longitudinal direction as in the example illustrated in FIG. 18 or may be a stepped shape orthogonal to the longitudinal direction as in the example illustrated in FIG. 19.

Figure 20:
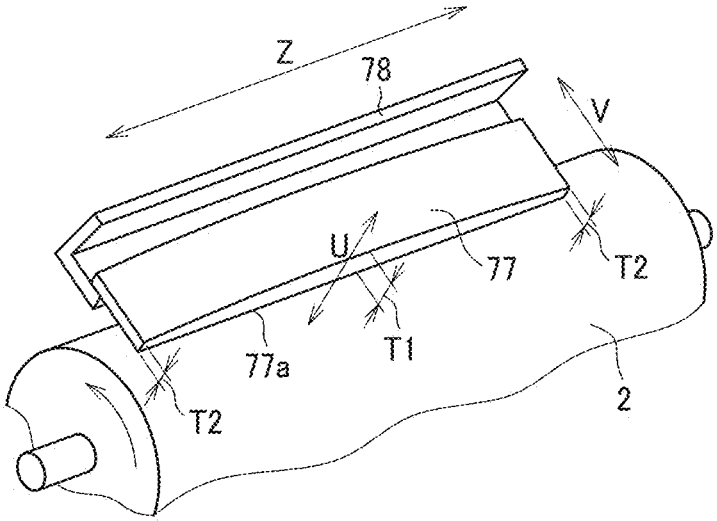
FIG. 20 is a schematic perspective view of an example of the cleaning blade having different thicknesses between a center and both ends.

Another structure to reduce the friction force between the cleaning blade 77 and the photoconductor 2 is the cleaning blade 77 having different thicknesses in the longitudinal direction (the direction indicated by arrow Z) as illustrated in FIG. 20. The "thickness" of the cleaning blade 77 means a dimension in a direction indicated by arrow U in FIG. 20 intersecting both the longitudinal direction of the cleaning blade 77 indicated by arrow Z and a protruding direction indicated by arrow V in which the cleaning blade 77 protrudes from the blade holder 78. As the thickness of the cleaning blade 77 is thinner, the cleaning blade 77 is more easily bent, and thus the contact pressure of the cleaning blade 77 with respect to the photoconductor 2 becomes smaller. As a result, the friction force becomes small.

Therefore, as illustrated in FIG. 20, setting thicknesses of both ends of the cleaning blade 77 in the longitudinal direction smaller than a thickness of the central portion of the cleaning blade 77 (T1<T2) can reduce the friction forces between the photoconductor 2 and both ends of the cleaning blade 77 at which the curling is likely to occur. Similar to the above-described cleaning blade 77 having different free lengths, the thickness of the cleaning blade 77 may be continuously reduced from the center to both ends in the longitudinal direction or may be reduced only at both ends having a certain length from both ends in the longitudinal direction in which the curling is particularly likely to occur.

Another structure to reduce the friction force between the cleaning blade 77 and the photoconductor 2 is the cleaning blade 77 including portions made of different materials. Since the contact pressure of the cleaning blade 77 made of a material having a low rebound resilience with respect to the photoconductor 2 is small, the friction force can be reduced.

Figure 21:
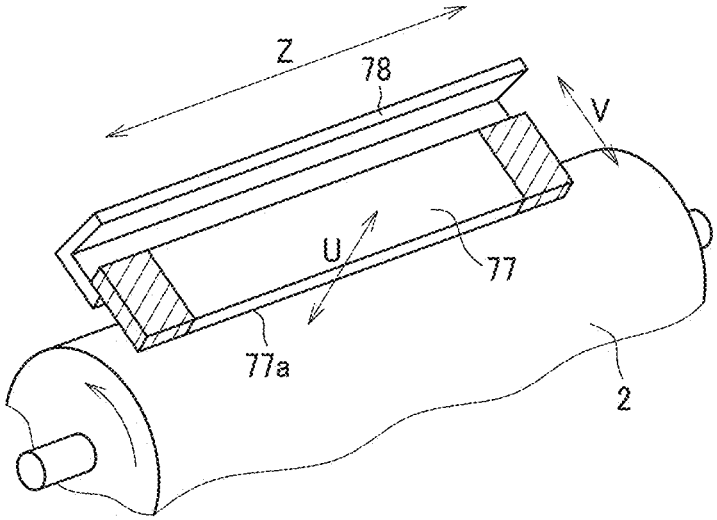
FIG. 21 is a schematic perspective view of an example of the cleaning blade having a center and both ends made of different materials.

For example, in the example illustrated in FIG. 21, the cleaning blade 77 includes both ends (hatched portions in FIG. 21) in the longitudinal direction of the cleaning blade 77, and both ends are made of a material having lower rebound resilience than other portions including the central portion. The above-described structure reduces the friction force between the photoconductor 2 and both ends of the cleaning blade 77 in which the curling is likely to occur and can prevent the curling on both ends.

Figure 22:
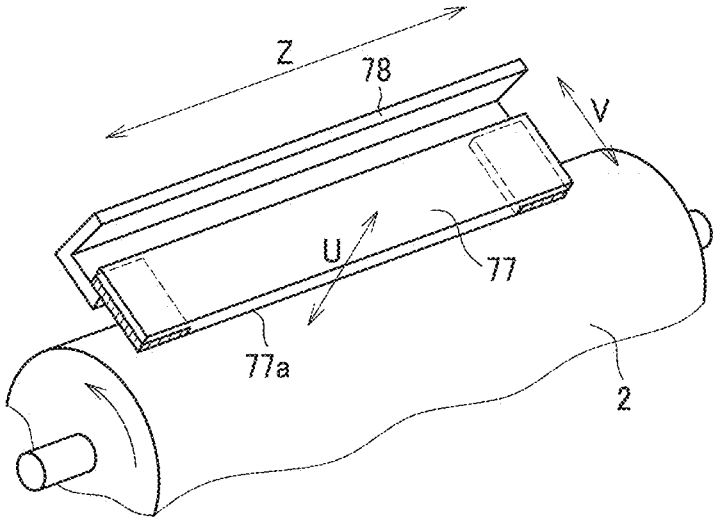
FIG. 22 is a schematic perspective view of an example of the cleaning blade having both ends, each including a portion in a thickness direction made of a material different from a material of another portion.

The end made of different material is not limited to the entire portion in the thickness direction U of the cleaning blade 77 as in the example illustrated in FIG. 21. As in the example illustrated in FIG. 22, a part of the end in the thickness direction U (a hatched portion in FIG. 22) may be made of the different material. The part of the end of the cleaning blade 77 in the thickness direction U (the hatched portion in FIG. 22) made of the material having the lower rebound resilience preferably contacts the photoconductor 2.

Figure 23:
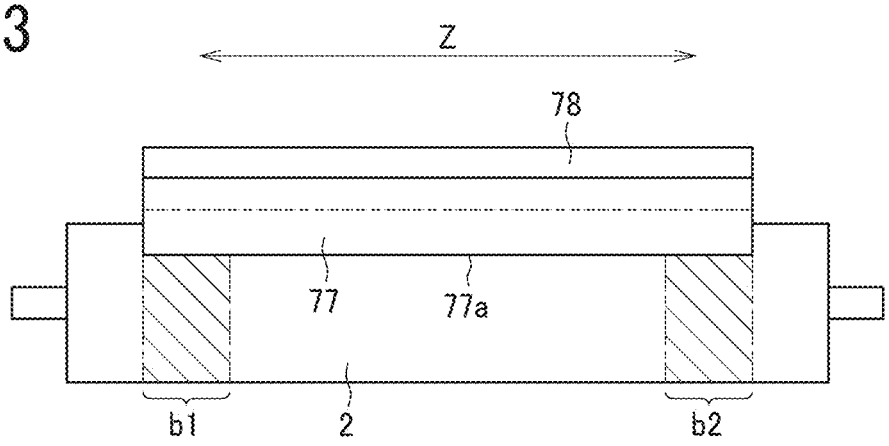
FIG. 23 is a schematic front view of an example of the cleaning blade and a photoconductor having different lubricating properties between a center and both ends.

Another structure to reduce the friction force between the cleaning blade 77 and the photoconductor 2 is a structure increasing lubricity between the cleaning blade 77 and the photoconductor 2 on both ends in which the curling of the cleaning blade 77 easily occurs. For example, as illustrated in FIG. 23, the lubricant supply device supplies the regions b1 and b2 of the photoconductor 2 that are in contact with both ends of the cleaning blade 77 in which the curling is likely to occur with the lubricant having higher lubricity than the lubricant supplied to the other regions of the photoconductor 2 including the center of the photoconductor 2. The above-described structure reduces the friction forces between the photoconductor 2 and both ends of the cleaning blade 77 and can prevent the curling. Alternatively, the lubricant supply device may be configured to supply the lubricant to only the region of the photoconductor 2 in which the lubricity between the cleaning blade 77 and the photoconductor 2 is increased.

As the lubricant, for example, a solid lubricant including fatty acid metal salt may be used. The fatty acid metal salt includes, for example, lauroyl lysine, monocetyl phosphate sodium zinc salt, lauroyltaurine calcium, and fatty acid metal salt having a lamellar crystal structure such as fluororesin, zinc stearate, calcium stearate, barium stearate, aluminum stearate, and magnesium stearate. Alternatively, a liquid lubricant such as silicone oil, fluorine-based oil, or natural wax may be used.

The above-described various methods for reducing the friction force between the cleaning blade 77 and the photoconductor 2 may be used in combination. For example, both ends having the long free lengths and the small thicknesses in the longitudinal direction of the cleaning blade 77 can effectively reduce the friction forces between both ends of the cleaning blade 77 and the photoconductor 2.

The image forming apparatus 100 is configured so that the friction forces between the photoconductor 2 and the both ends of the cleaning blade 77 are smaller than the friction force between the photoconductor 2 and the center portion of the cleaning blade 77 in the above-described embodiments but may be configured so that the friction force between only one end of the cleaning blade 77 and the photoconductor 2 is smaller than the friction force between the photoconductor 2 and the center of the cleaning blade 77. For example, as in the example illustrated in FIG. 15, the image forming apparatus including the heater 22 having the seventh block in which the temperature is highest may be configured so that the friction force between the photoconductor 2 and one end of the cleaning blade 77 facing the seventh block is smaller than the friction force between the photoconductor 2 and another portion of the cleaning blade 77.

The image forming apparatus according to the present embodiments is configured to have the following relation of the friction forces between photoconductor 2 and portions of the rubbing portion 77*a* in which the cleaning blade 77 rubs photoconductor 2. That is, the friction force between the photoconductor 2 and a portion of the rubbing portion 77*a* facing the region of the heater 22 generating the largest heat generation amount is smaller than the friction force between the photoconductor 2 and a portion of the rubbing portion 77*a* facing the region of the heater 22 generating the smallest heat generation amount. In other words, the above relation is expressed as follows by using currents flowing through the power supply lines 62A, 62B, and 62D instead of the heat generations amounts in the heater 22. That is, the friction force between the photoconductor 2 and a portion of the rubbing portion 77*a* facing the region of the heater 22 in which the largest total current flows through the power supply lines 62A, 62B, and 62D is smaller than the friction force between the photoconductor 2 and a portion of the rubbing portion 77*a* facing the region of the heater 22 in which the smallest total current flows through the power supply lines 62A, 62B, and 62D.

The application of the present disclosure is not limited to the cleaning blade 77 that cleans the surface of the photoconductor 2. The present disclosure may also be applied to a blade that rubs against a rotator other than the photoconductor 2. For example, the present disclosure may be also applicable to the cleaning blade 69 that cleans the surface of the intermediate transfer belt 11 illustrated in FIG. 1.

Figure 24:
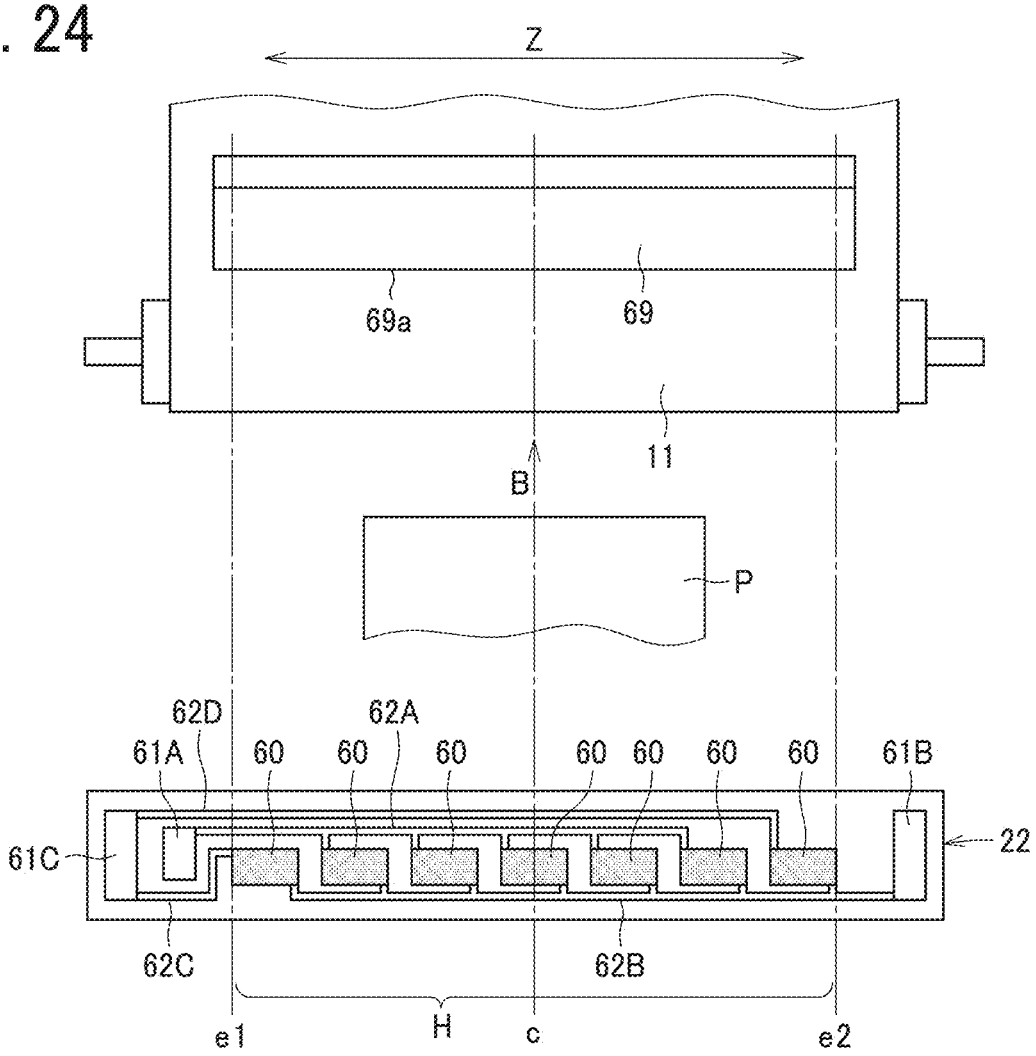
FIG. 24 is a schematic diagram illustrating a positional relationship between the cleaning blade to clean an intermediate transfer belt and a heater included in the fixing device.

FIG. 24 is a schematic diagram illustrating a positional relationship between the cleaning blade 69 to clean the surface of the intermediate transfer belt 11 and the heater 22 included in the fixing device.

As illustrated in FIG. 24, since both the cleaning blade 69 for the intermediate transfer belt and the heater 22 extend longitudinally in the same direction Z (the direction orthogonal to the sheet conveyance direction), the temperature distribution over the longitudinal direction of the heater 22 influences the temperature distribution of the cleaning blade 69 in the longitudinal direction of the cleaning blade 69. Both the rubbing portion 69*a* of the cleaning blade 69 rubbing the intermediate transfer belt 11 and a heat generation area H in which the resistive heat generators 60 of the heater 22 are disposed have substantially the same lengths (lengths in a direction orthogonal to the sheet conveyance direction) and are disposed over a range including the maximum sheet width or the maximum image formation area width. The housing of the belt cleaner 10 and the like are disposed between the rubbing portion 69*a* and the heater 22. Accordingly, both ends of the rubbing portion 69*a* of the cleaning blade 69 for the intermediate transfer belt and both ends of the heater 22 in the longitudinal direction are indirectly facing each other.

Similar to the above-described embodiments, the heater 22 has both ends e1 and e2 having the higher temperatures than the center c in the longitudinal direction of the heat generation area H. The temperature distribution of the heater 22 influences the cleaning blade 69 for the intermediate transfer belt such that a temperature of an end of the rubbing portion 69*a* becomes higher than a temperature of a center portion of the rubbing portion 69*a* in the longitudinal direction Z (that is the direction orthogonal to the sheet conveyance direction). Since the cleaning blade 69 for the intermediate transfer belt is closer to the heater 22 than the cleaning blade 77 for the photoconductor, the cleaning blade 69 is more likely to be affected by the heat of the heater 22 than the cleaning blade 77 for the photoconductor.

As described above, since temperatures at both ends of the cleaning blade 69 for the intermediate transfer belt in the longitudinal direction is higher than a temperature at the center of the cleaning blade 69, the curling of the cleaning blade 69 may occur at both ends. Accordingly, it is preferable to apply the present embodiments to the cleaning blade 69 for the intermediate transfer belt. The rubbing portion 69*a* in which the cleaning blade 69 rubs the intermediate transfer belt 11 includes longitudinal both ends facing the high temperature portions of the heater 22. The friction forces between the intermediate transfer belt 11 and the longitudinal both ends of the cleaning blade 69 are preferably set to be smaller than the friction force between the intermediate transfer belt 11 and the center of the cleaning blade 69 in the longitudinal direction. The above-described structure can effectively prevent the curling of the cleaning blade 69 for the intermediate transfer belt 11 that is caused by rotation of the intermediate transfer belt 11. A specific structure to reduce the friction force between the cleaning blade 69 and the intermediate transfer belt 11 may be each structure described in the above embodiments. In the above description, the friction force between the intermediate transfer belt 11 and the portion of the rubbing portion 69*a* facing the heater 22 is set. In other words, the cleaning blade 69 is configured to have a small friction force between the intermediate transfer belt 11 and a portion of the rubbing portion 69*a* corresponding to the high temperature portion of the heater 22. The high temperature portion of the heater 22 is the high heat generation portion, in the present embodiment, each of both ends of the heater 22. The heater 22 in the above-described embodiment generates a larger heat amount at both ends than another portion. When the heater 22 generates a larger heat amount at one end than another portion, the cleaning blade 69 is configured to have a smaller friction force at one end of the rubbing portion 69*a* facing the one end of the heater 22 than another portion of the rubbing portion 69*a*.

Figure 25:
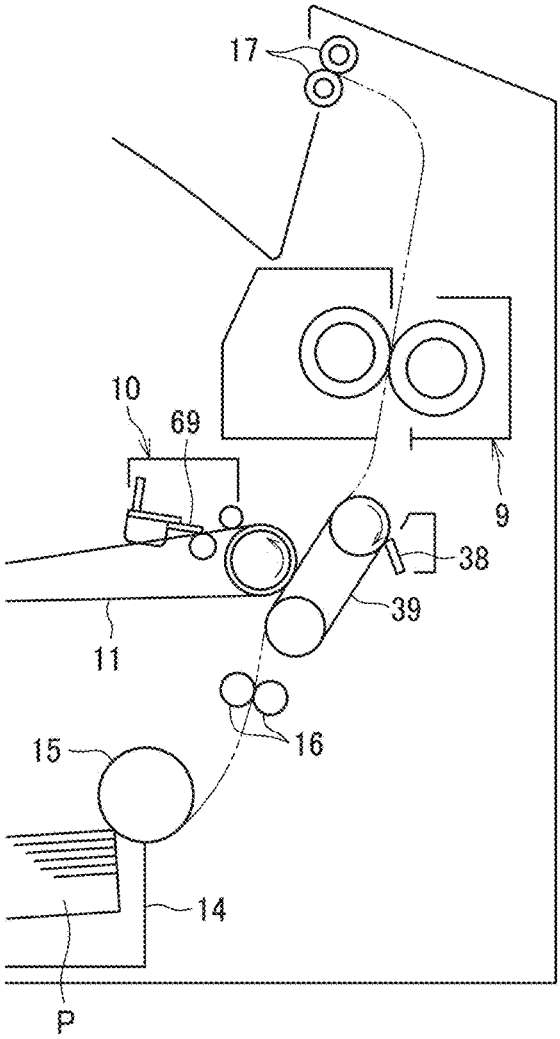
FIG. 25 is a schematic diagram illustrating the cleaning blade to clean a secondary transfer belt.

In addition to the cleaning blade 77 for the photoconductor and the cleaning blade 69 for the intermediate transfer belt, the present embodiments may be applied to the cleaning blade 38 to clean the surface of the secondary transfer belt 39 as a transferor as in the example illustrated in FIG. 25.

As described above, in particular, the present embodiments are preferably applied to the image forming apparatus including a heating member that is likely to occur an uneven temperature distribution because the present embodiments can prevent the curling of the cleaning blade caused by the uneven temperature distribution of the heating member even if the heating member has the uneven temperature distribution.

The heating member that is likely to occur the uneven temperature distribution is the heater 22 described above in which the unintended shunt occurs, but a configuration of the heating member included in the image forming apparatus according to the present embodiments is not limited to the above-described configuration. For example, the present embodiments may be applied to the image forming apparatus including the heater 22 as illustrated in FIG. 26.

Figure 26:
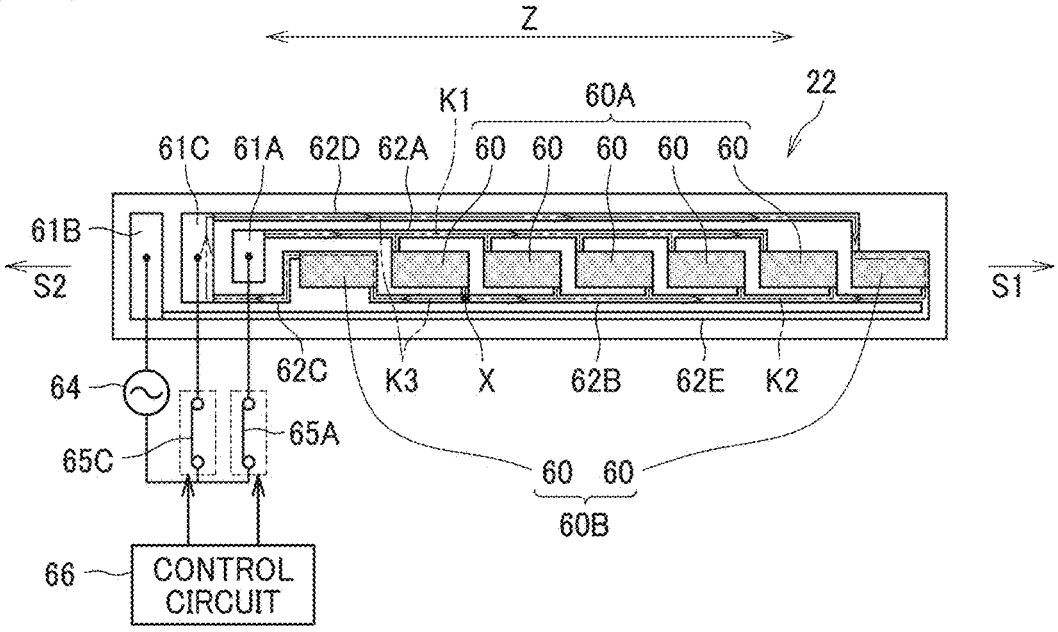
FIG. 26 is a schematic diagram illustrating another example of the heater in which an unintended shunt occurs.

The heater 22 illustrated in FIG. 26 is different from the above-described heater 22 illustrated in FIG. 11 in that all the electrodes 61A, 61B, and 61C are disposed on one end of the heater 22 (that is, left end in FIG. 26) in the longitudinal direction of the heater 22. That is, the position of the second electrode 61B in the heater 22 illustrated in FIG. 26 is opposite to the position of the second electrode 61B in the heater 22 illustrated in FIG. 11 in the lateral direction of FIGS. 11 and 26. In the heater 22 illustrated in FIG. 26, each of the resistive heat generators 60 and the second electrode 61B are coupled to each other via, in addition to the second power supply line 62B, a fifth power supply line 62E disposed so as to be folded back in the longitudinal direction (that is the direction indicated by the arrow Z) from an end of the second power supply line 62B.

However, the following same points of the conductive paths of the heaters 22 illustrated in FIGS. 11 and 26 generates the unintended shunt similar to the above description when power is supplied to the first resistive heat generator group 60A including the resistive heat generators 60 other than the resistive heat generators 60 at both ends. That is, the heater 22 illustrated in FIG. 26 and the heater 22 illustrated in FIG. 11 have common conductive paths that are a first conductive path K1, a second conductive path K2, and a third conductive path K3. Specifically, the first conductive path K1 couples the first electrode 61A to each of the resistive heat generators of the first resistive heat generator group 60A other than the resistive heat generators at both ends. The second conductive path K2 extends in the longitudinal direction of the heater 22 from each of the resistive heat generators 60 other than the resistive heat generators at both ends toward a first direction S1 (that is the right direction in FIG. 11 or FIG. 26) and directly or indirectly couples the second electrode 61B to each of the resistive heat generators 60 other than the resistive heat generators at both ends. The third conductive path K3 is a conductive path that branches off from the second conductive path K2, extends toward a second direction S1 (that is the left direction in FIG. 11 or FIG. 26) opposite to the first direction S2, and is coupled to the second conductive path K2 without passing through the first conductive path K1.

Figure 27:
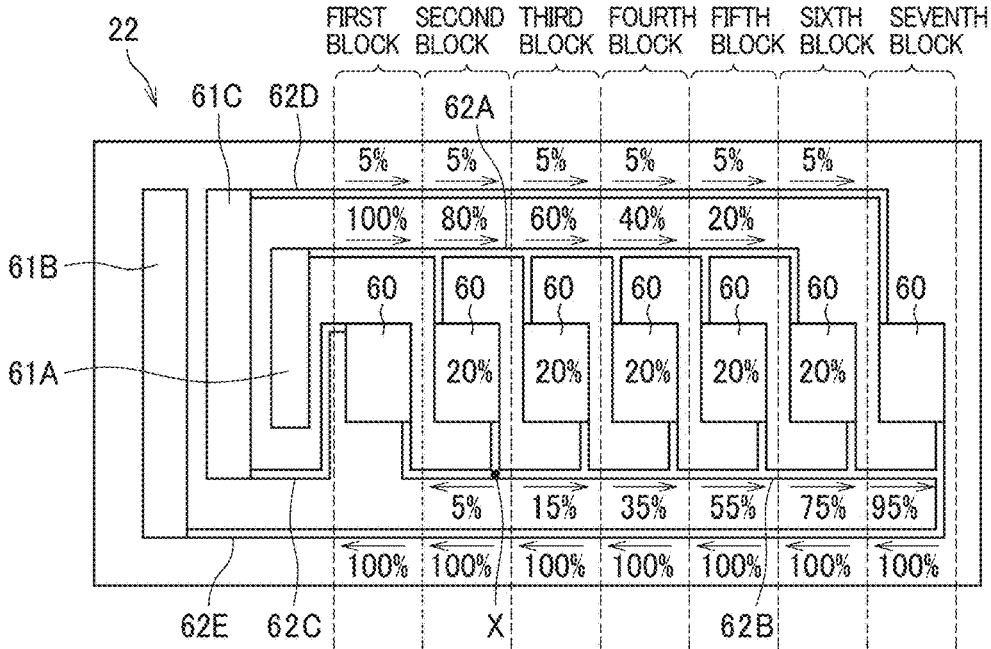
FIG. 27 is a schematic top view of the heater of FIG. 26, a table, and a graph illustrating an uneven temperature distribution generated in the heater when the resistive heat generators other than the resistive heat generators at both ends generate heat.
Figure 27:
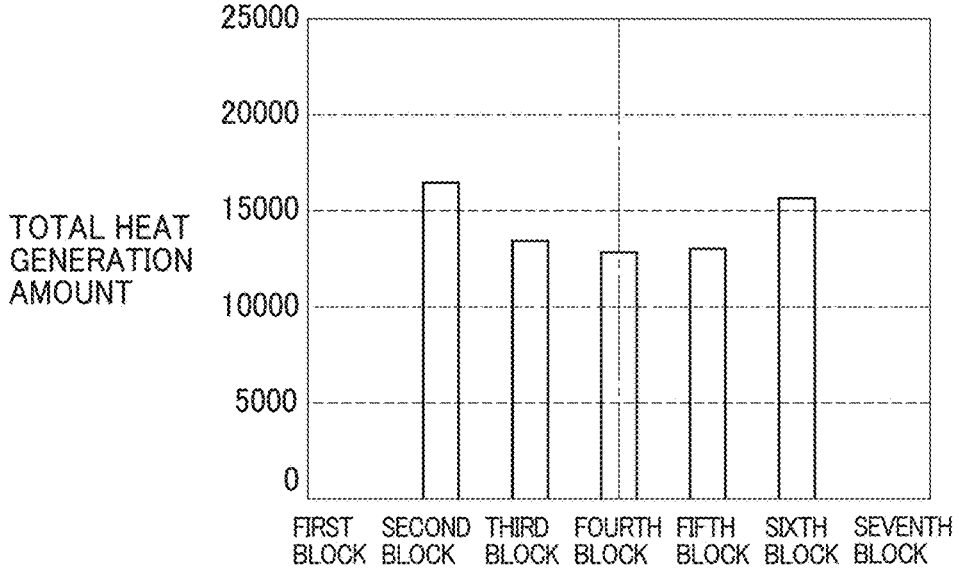

FIG. 27 is a schematic top view of the heater 22 of FIG. 26, a table, and a graph illustrating heat generation amounts generated by the power supply lines 62A, 62B, 62D, and 62E and total heat generation amounts in each block when the resistive heat generators 60 other than the resistive heat generators 60 at both ends generate heat. As can be seen from the table and the graph in FIG. 27, the total heat generation amounts generated by the power supply lines in both end blocks (that is, the second block and the sixth block) are also larger than the total heat amount of the center block (that is, the fourth block) in this case. As a result, the temperatures of the heater 22 at both ends are higher than the temperature at the center portion in the longitudinal direction of the heater 22.

Figure 28:
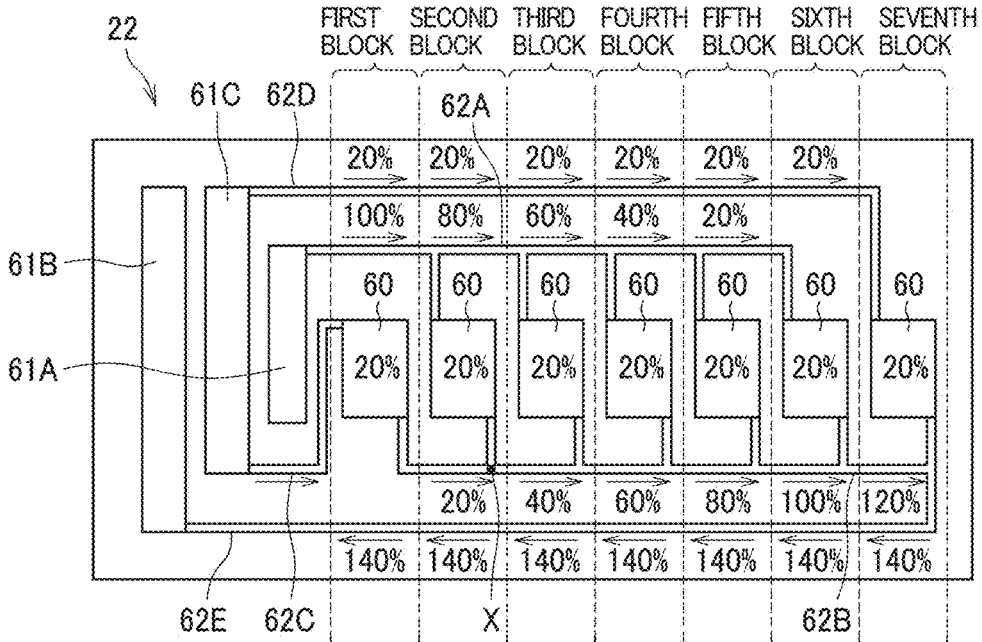
FIG. 28 is a schematic top view of the heater of FIG. 26, a table, and a graph illustrating an uneven temperature distribution generated in the heater when all resistive heat generators are energized.
Figure 28:
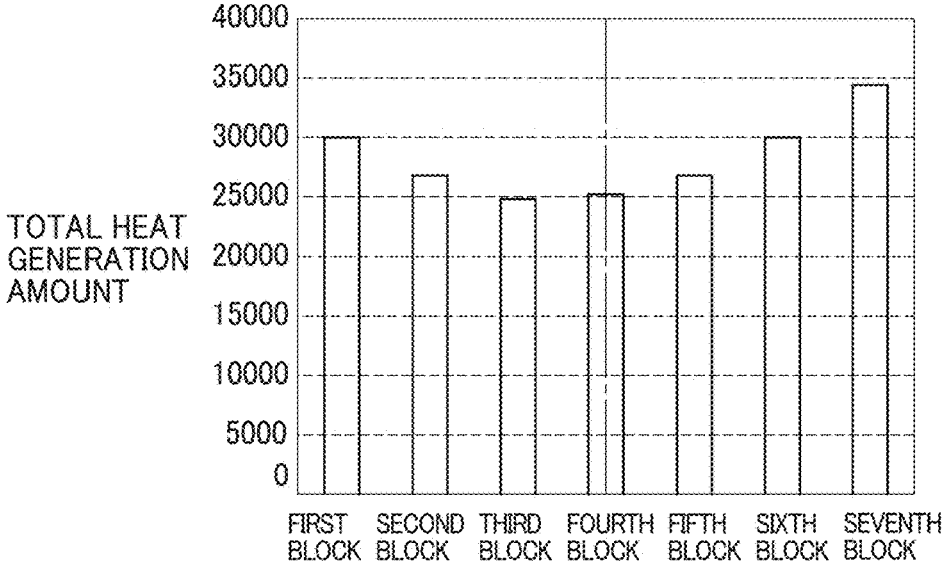

FIG. 28 is a schematic top view of the heater 22 of FIG. 26, a table, and a graph illustrating heat generation amounts generated by the power supply lines 62A, 62B, 62D, and 62E and total heat generation amounts in each block when all the resistive heat generators 60 generate heat. Also, in this case, since the total heat generation amounts generated by the power supply lines in each of both end blocks (i.e., the first block and the seventh block) is larger than the total heat generation amount in the center block (i.e., the fourth block), the temperatures at both ends of the heater 22 is higher than the temperature at the center portion in the longitudinal direction of the heater 22.

As described above, since the heater 22 illustrated in FIG. 26 also has the uneven temperature distribution in which the temperature is higher on both ends than on the center portion in the longitudinal direction of the heater 22, applying the present embodiments can effectively prevent the curling of the blade caused by the uneven temperature distribution.

Since the embodiments of the present disclosure can improve an issue of the blade caused by the uneven temperature distribution of the heating member, that is, the curling of the blade, the embodiments can be applied to a configuration using a small heater or a heater having a large heat generation ability for high-speed printing that are likely to generate the uneven temperature distribution.

Specifically, a particularly large effect can be expected by applying the present embodiments of the present disclosure to the image forming apparatus including the following small heater.

Figure 29:
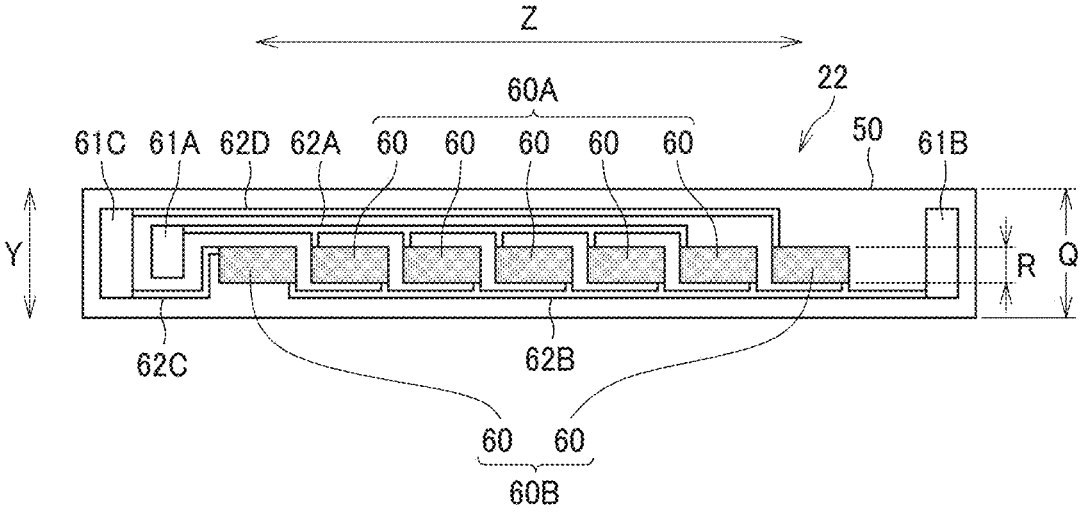
FIG. 29 is a plan view of the heater downsized.

The following Table 1 describes results of experiments that examined temperature differences caused by the uneven temperature distribution occurring in the heaters that are downsized in the short-side direction. Specifically, a plurality of heaters are prepared in the experiments. The heaters have different ratios (R/Q) of short-side dimensions R and Q. The short-side dimension R is a dimension of the resistive heat generators 60 in the short-side direction of the resistive heat generators 60, and the short-side dimension Q is a dimension of the base 50 in the short-side direction of the base 50, as illustrated in FIG. 29. In each of experiments, the temperature difference between the center and the end in the longitudinal direction of the heat generation area of each heater was measured. In the experiments, the surface temperatures of the heater were measured using an infrared thermography FLIR T620 manufactured by FLIR Systems. When the ratio (R/Q) of the short-side dimensions R and Q is 80% or more, the ratio of the short-side dimension of the resistive heat generators 60 to the short-side dimension of the base 50 is too large to design spaces for disposing the power supply lines. Therefore, designing the heater having the ratio (R/Q) 80% or more is difficult. Thus, the measurement about the heater having the ratio (R/Q) 80% or more was suspended.

TABLE 1

| Ratio (R/Q) of the dimensions in the short-side direction | Temperature difference between the center and the end |
|---|---|
| 20% or more and less than 25% | Less than 2° C. |
| 25% or more and less than 40% | 2° C. or more and less than 5° C. |
| 40% or more and less than 70% | 5° C. or more |

As illustrated in Table 1, the larger the ratio (R/Q) of the dimensions in the short-side direction is, the larger the temperature difference between the longitudinal center of the heat generation area and the end of the heat generation area is. This means that the temperature difference between both ends of the heater in the longitudinal direction of the heater is likely to be significantly large in the heater having the large ratio (R/Q) of the dimensions in the short-side direction, that is, in the heater miniaturized in the short-side direction. In particular, the heater having the ratio (R/Q) of the dimensions in the short-side direction that is 25% or more or 40% or more has a large temperature difference between the center and the end in the longitudinal direction of the heat generation area, that is, 5° C. or more, and thus the temperature difference between both ends of the heater in the longitudinal direction is likely to become significantly large. Accordingly, particularly large effect can be expected by applying the present embodiment of the present disclosure to the image forming apparatus including the heater having the ratio (R/Q) of the dimensions in the short-side direction that is equal to or larger than 25% and smaller than 80% or equal to or larger than 40% and smaller than 80%.

Figure 30:
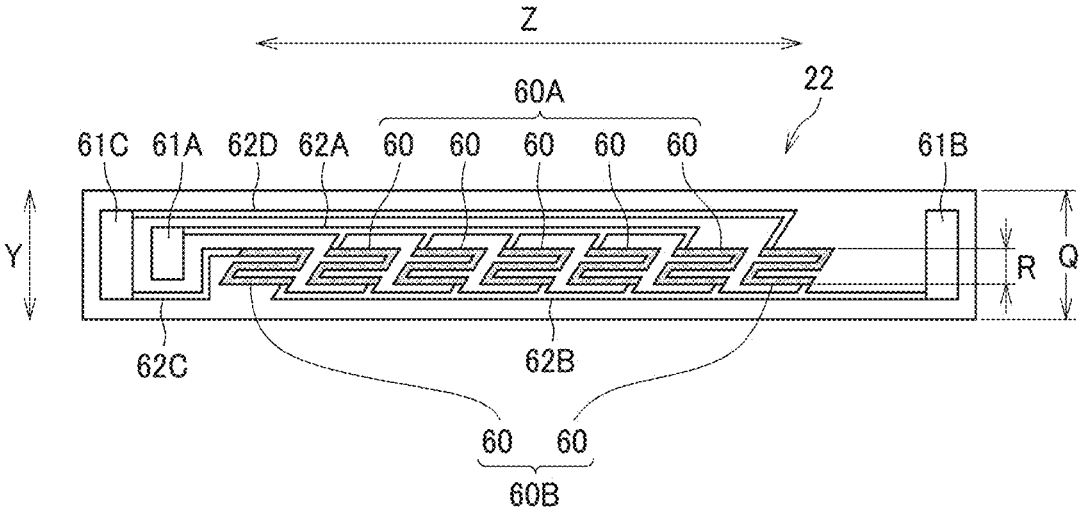
FIG. 30 is a plan view of a variation of the heater downsized.

The heater disposed in the fixing device is not limited to the heater 22 including block-shaped (in other words, square-shaped) resistive heat generators 60 as illustrated in FIG. 29. The heaters 22 may include resistive heat generators 60 each having a shape in which a straight line is folded back as illustrated in FIG. 30. Note that, in the heater 22 illustrated in FIG. 30, the short-side dimension R of each of the resistive heat generators 60 refers to a short-side dimension of each of the entire resistive heat generators 60, not to a thickness of the straight-line portion of the resistive heat generator 60 folded back. By contrast, the short-side dimension Q of the base 50 may be changed in accordance with the longitudinal position of the heater 22. In such a case, the short-side dimension Q of the base 50 is the smallest dimension of the base 50 in the short-side direction within a longitudinal area (the heat generation area) including the resistive heat generators 60 arranged in the longitudinal direction of the base 50.

In the embodiments of the present disclosure, the resistive heat generator having a positive temperature coefficient (PTC) characteristic may be used to further prevent the longitudinal unevenness in temperature of the heater 22. The PTC property defines a property in which the resistance value increases as the temperature increases, for example, a heater output decreases under a given voltage. The heat generator having the PTC property starts quickly with an increased output at low temperatures in the heater and prevents overheating of the heater with a decreased output at high temperatures in the heater. For example, if a temperature coefficient of resistance (TCR) of the PTC property is in a range of from about 300 ppm/° C. to about 4,000 ppm/° C., the heater 22 is manufactured at reduced costs while retaining a resistance value needed for the heater 22. The TCR is preferably in a range of from about 500 ppm/° C. to about 2,000 ppm/° C.

The TCR can be calculated using the following equation (3). In the equation (3), T0 represents a reference temperature, T1 represents a freely selected temperature, R0 represents a resistance value at the reference temperature T0, and R1 represents a resistance value at the selected temperature T1. For example, in the heater 22 described above with reference to FIG. 11, the TCR is 2,000 ppm/° C. from the equation (3) when the resistance values between the first electrode 61A and the second electrode 61B are 10Ω (i.e., resistance value R0) and 12Ω (i.e., resistance value R1) at 25° C. (i.e., reference temperature T0) and 125° C. (i.e., selected temperature T1), respectively.

Equation 3.

$$\text{Temperature coefficient of resistance (TCR)}=(R1-R0)/R0/(T1-T0)\times 10^6 \quad (3)$$

Applications of the embodiments of the present disclosure are not limited to the image forming apparatus including the fixing device 9 as illustrated in FIG. 3. The embodiments of the present disclosure are also applicable to image forming apparatuses including fixing devices as illustrated in FIGS. 31 to 33, respectively, other than the fixing device 9 described above.

Figure 31:
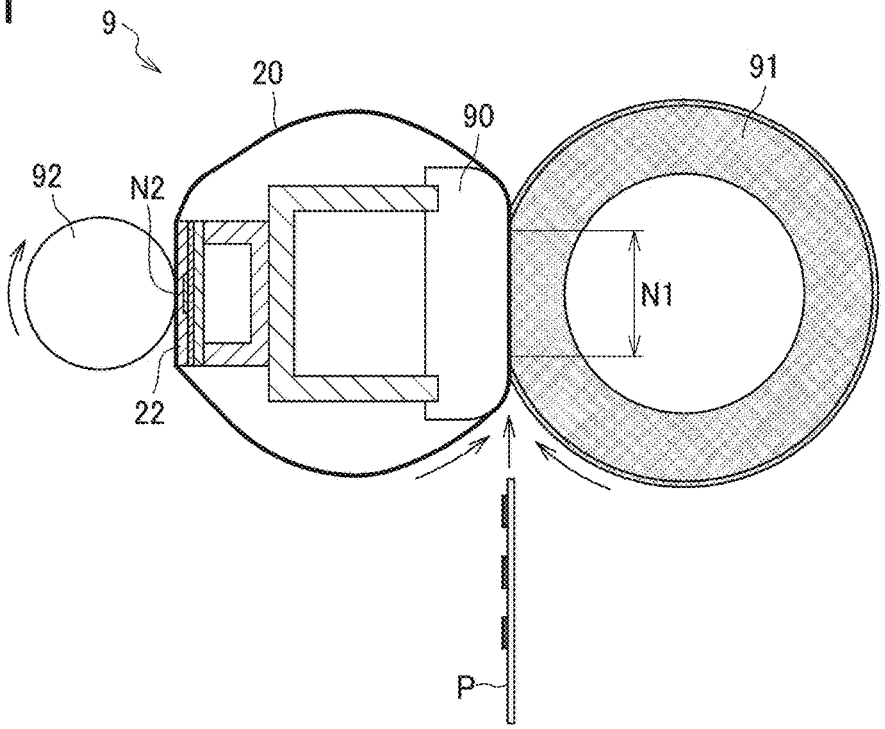
FIG. 31 is a schematic diagram illustrating a fixing device as a variation of the fixing device of FIG. 3.

The fixing device 9 illustrated in FIG. 31 is different from the above-described fixing device in that a fixing nip N1 through which the sheet P passes and a heating nip N2 through which the fixing belt 20 is heated by the heater 22 are set at different positions. Specifically, the fixing device 9 illustrated in FIG. 31 includes the heater 22 and the nip formation pad 90 disposed 1800 opposite to each other in the rotation direction of the fixing belt 20. The pressure roller 91 presses against the fixing belt 20 to form the fixing nip N1, and the pressure roller 92 presses against the fixing belt 20 to form the heating nip N2.

Figure 32:
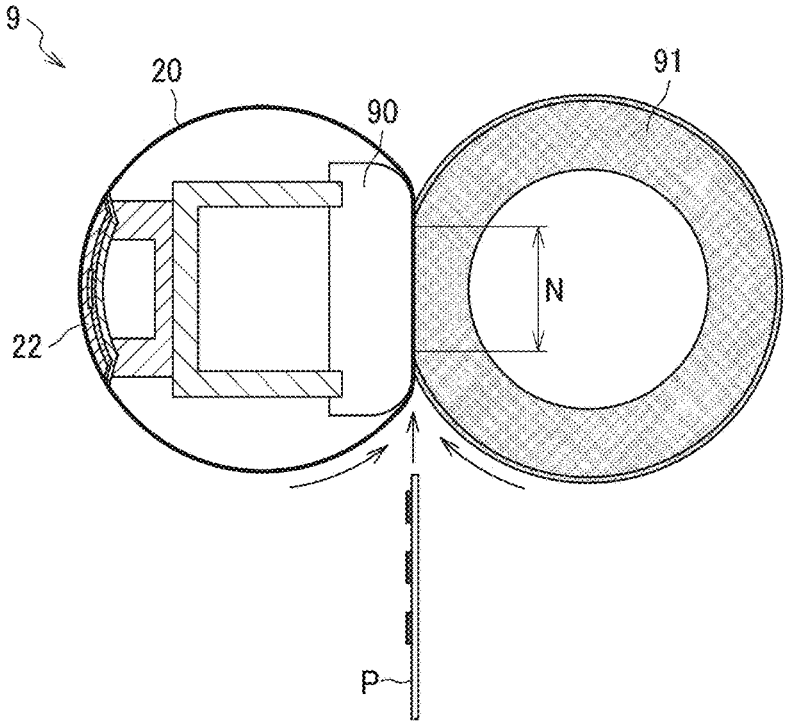
FIG. 32 is a schematic diagram illustrating a fixing device as another variation of the fixing device of FIG. 3.

Next, the fixing device 9 illustrated in FIG. 32 omits the above-described pressure roller 92 adjacent to the heater 22 from the fixing device 9 illustrated in FIG. 31 and includes the heater 22 formed to be arc having a curvature of the fixing belt 20. The other configuration is the same as the configuration illustrated in FIG. 31. In this case, the arc shaped heater 22 surely maintains a length of the contact between the fixing belt 20 and the heater 22 in the belt rotation direction to efficiently heat the fixing belt 20.

Figure 33:
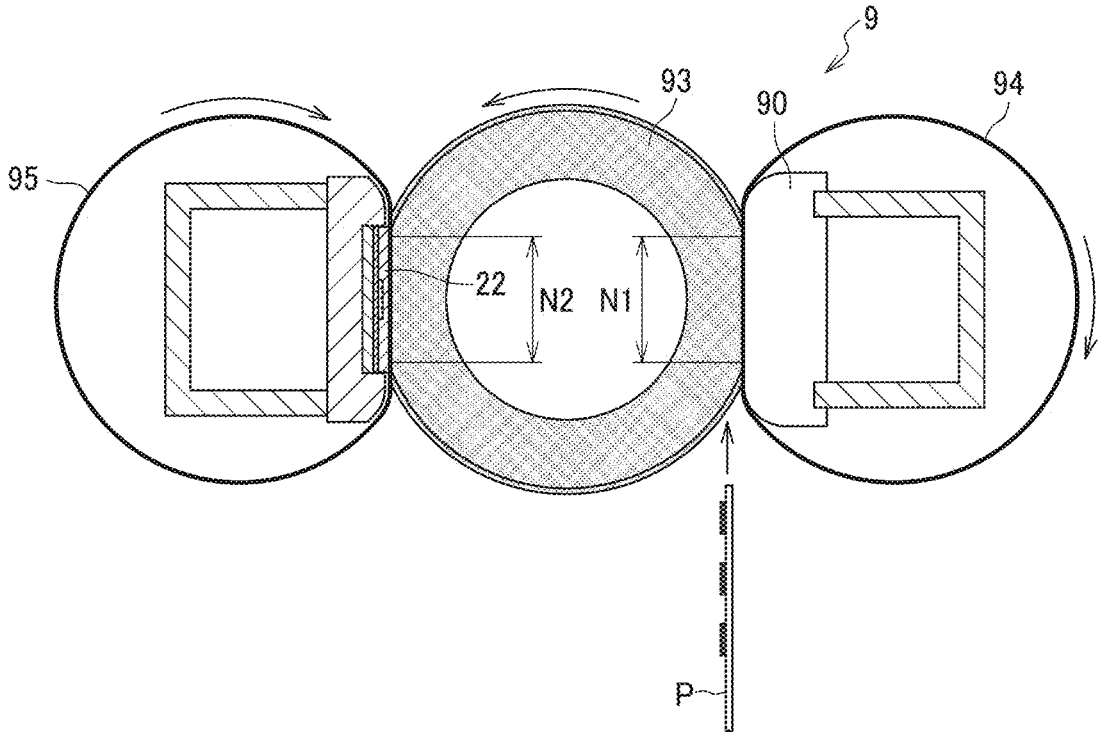
FIG. 33 is a schematic diagram illustrating a fixing device as a still another variation of the fixing device of FIG. 3.

Finally, the fixing device 9 illustrated in FIG. 33 includes belts 94 and 95 disposed on both sides of the roller 93. Also, in this case, similar to the example illustrated in FIG. 31, the fixing nip N1 and the heating nip N2 are set at different positions. On the right side of FIG. 33, the nip formation pad 90 is pressed against the roller 93 via one belt 94 to form the nip N1, and on the left side of FIG. 33, the heater 22 is pressed against the roller 93 via the other belt 95 to form the nip N2.

Applying the present embodiments of the present disclosure to the image forming apparatus including one of the fixing devices as illustrated in FIGS. 31 to 33 described above can prevent the curling of the blade caused by the uneven temperature distribution of the heating member, improve image quality, and is helpful for downsizing the image forming apparatus or increasing the print speed. In this specification, "the end of the rubbing portion directly facing the end of the heater" means that a member does not substantially exist between the rubbing portion and the heater, and "the end of the rubbing portion indirectly facing the end of the heater" means that another member substantially exist between the rubbing portion and the heater. The present embodiments can be applied to both configurations described above without any problem.

An image forming apparatus that the present embodiments can be applied is not limited to the above-described image forming apparatus including the fixing device that is an example of the heating device. The present embodiments are also applicable to an image forming apparatus including a heating device that heats a recording medium for a purpose other than fixing the toner image.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. The number, position, and shape of the components described above are not limited to those embodiments described above. Desirable number, position, and shape can be determined to perform the present disclosure.

What is claimed is:

1. An image forming apparatus configured to form an image on a recording medium, comprising:

a heating device being configured to heat the recording medium, the heating device extending in a direction orthogonal to a conveyance direction of the recording medium and including a plurality of heating blocks, the heating device being configured to generate a larger amount of heat at a first end and a second end of the heating device in the direction orthogonal to the conveyance direction than at a center of the heating device in the direction orthogonal to the conveyance direction, the first end associated with at least one first heating block, the second end associated with at least one second heating block, and the center associated with at least one center heating block;

at least one rotator; and at least one blade including a rubbing portion, the rubbing portion extending in the direction orthogonal to the conveyance direction, a first end of the rubbing portion in the direction orthogonal to the conveyance direction facing the first end of the heating device in the direction orthogonal to the conveyance direction, a second end of the rubbing portion in the direction orthogonal to the conveyance direction facing the second end of the heating device in the direction orthogonal to the conveyance direction, and the rubbing portion being configured to rub the at least one rotator, wherein the at least one rotator and the at least one blade are configured such that a friction force between the at least one rotator and the first end of the rubbing portion is smaller than a friction force between the at least one rotator and a center of the rubbing portion in the direction orthogonal to the conveyance direction.

2. The image forming apparatus according to claim 1, wherein the at least one rotator and the at least one blade are configured such that a friction force between the at least one rotator and the second end of the rubbing portion is smaller than the friction force between the at least one rotator and the center of the rubbing portion.

3. The image forming apparatus according to claim 1, wherein the at least one blade is configured such that a contact pressure of the rubbing portion with respect to the at least one rotator is smaller at the first end of the rubbing portion than at the center of the rubbing portion.

4. The image forming apparatus according to claim 1, further comprising at least one holder configured to hold the at least one blade, wherein a portion of the at least one blade protruding from the at least one holder toward the at least one rotator is longer at the first end of the rubbing portion than at the center of the rubbing portion.

5. The image forming apparatus according to claim 4, wherein a part of the at least one holder holding the at least one blade is shorter at the first end of the rubbing portion than at the center of the rubbing portion.

6. The image forming apparatus according to claim 1, wherein the at least one blade is thinner at the first end of the rubbing portion than at the center of the rubbing portion.

7. The image forming apparatus according to claim 1, wherein a rebound resilience of the at least one blade is smaller at the first end of the rubbing portion than at the center of the rubbing portion.

8. The image forming apparatus according to claim 1, wherein lubricity of the at least one blade with respect to the at least one rotator is higher at the first end of the rubbing portion than at the center of the rubbing portion.

9. The image forming apparatus according to claim 8, wherein the at least one rotator is at least one of a photoconductor, an intermediate transfer belt, a secondary transfer belt, or any combinations thereof; and the image forming apparatus further includes, at least one lubricant supply device configured to supply at least one lubricant to the at least one rotator such that the lubricity of the at least one blade with respect to the at least one rotator is higher at the first end of the rubbing portion than at the center of the rubbing portion.

10. The image forming apparatus according to claim 9, wherein the at least one lubricant is at least one solid lubricant.

11. The image forming apparatus according to claim 9, wherein the at least one lubricant is at least one liquid lubricant.

12. The image forming apparatus according to claim 1, wherein the at least one blade is formed such the first end of the rubbing portion is longer than at the center of the rubbing portion.

13. An image forming apparatus configured to form an image on a recording medium, comprising:

a heating device being configured to heat the recording medium, the heating device extending in a direction orthogonal to a conveyance direction of the recording medium, the heating device being configured such that a total value of squares of currents flowing through a first end and a second end of the heating device in the direction orthogonal to the conveyance direction is larger than a total value of squares of currents flowing through a center of the heating device in the direction orthogonal to the conveyance direction;

at least one a rotator; and at least one a blade including a rubbing portion, the rubbing portion extending in the direction orthogonal to the conveyance direction, the rubbing portion facing the heating device, the rubbing portion being configured to rub the at least one rotator, wherein the at least one rotator and the at least one blade are configured such that a friction force between the at least one rotator and a first end of the rubbing portion facing the first end of the heating device is smaller than a friction force between the at least one rotator and a center of the rubbing portion in the direction orthogonal to the conveyance direction.

14. The image forming apparatus according to claim 13, wherein the at least one rotator and the at least one blade are configured such that a friction force between the at least one rotator and a second end of the rubbing portion in the direction orthogonal to the conveyance direction facing the second end of the heating device is smaller than the friction force between the at least one rotator and the center of the rubbing portion.

15. The image forming apparatus according to claim 13, wherein the at least one blade is configured such that a contact pressure of the rubbing portion with respect to the at least one rotator is smaller at the first end of the rubbing portion than at the center of the rubbing portion.

16. The image forming apparatus according to claim 13, further comprising at least one a holder configured to hold the at least one blade, wherein a portion of the at least one blade protruding from the at least one holder toward the at least one rotator is longer at the first end of the rubbing portion than at the center of the rubbing portion.

17. The image forming apparatus according to claim 16, wherein a part of the at least one holder holding the at least one blade is shorter at the first end of the rubbing portion than at the center of the rubbing portion.

18. The image forming apparatus according to claim 13, wherein the at least one blade is thinner at the first end of the rubbing portion than at the center of the rubbing portion.

19. The image forming apparatus according to claim 13, wherein a rebound resilience of the at least one blade is smaller at the first end of the rubbing portion than at the center of the rubbing portion.

20. The image forming apparatus according to claim 13, wherein lubricity of the at least one blade with respect to the at least one rotator is higher at the first end of the rubbing portion than at the center of the rubbing portion.

* * * * *